US008459897B1

(12) United States Patent
Knapp

(10) Patent No.: US 8,459,897 B1
(45) Date of Patent: Jun. 11, 2013

(54) FRAGMENTED SLAB LIFTING APPARATUS AND METHOD

(76) Inventor: Ronald A. Knapp, Bonita Springs, FL (US)

( * ) Notice: Subject to any disclaimer, the term of this patent is extended or adjusted under 35 U.S.C. 154(b) by 0 days.

(21) Appl. No.: 13/491,872

(22) Filed: Jun. 8, 2012

(51) Int. Cl.
*E01C 23/10* (2006.01)

(52) U.S. Cl.
USPC ..... 404/78; 254/264

(58) Field of Classification Search
CPC ..... E01C 23/10
USPC ..... 404/75, 78; 254/124, 269; 405/229–230, 405/233
See application file for complete search history.

(56) References Cited

U.S. PATENT DOCUMENTS

| | | | | |
|---|---|---|---|---|
| 2,041,266 | A * | 5/1936 | Poulter | 404/78 |
| 2,794,336 | A | 6/1957 | Ballou | |
| 3,161,309 | A * | 12/1964 | Baudhuin et al. | 414/459 |
| 3,861,649 | A * | 1/1975 | Mosley | 254/124 |
| 4,194,853 | A * | 3/1980 | Barth et al. | 404/73 |
| 4,240,995 | A * | 12/1980 | Milne | 264/36.2 |
| 4,261,548 | A * | 4/1981 | Kaderabek | 254/131 |
| 4,491,452 | A | 1/1985 | Matovich | |
| 4,583,879 | A | 4/1986 | Hofman | |
| 4,962,913 | A | 10/1990 | Stewart | |
| 5,860,763 | A * | 1/1999 | Asplin | 404/78 |
| 6,102,614 | A | 8/2000 | Yukawa | |
| 6,203,242 | B1 | 3/2001 | Englund | |
| 6,558,071 | B1 | 5/2003 | Sproules | |
| 6,591,468 | B1 * | 7/2003 | Douglas | 29/266 |
| 6,595,718 | B2 | 7/2003 | Smith | |
| 6,688,808 | B2 | 2/2004 | Lee | |
| 6,752,566 | B2 | 6/2004 | Smith | |
| 7,448,176 | B2 | 11/2008 | Drake | |
| 8,118,518 | B2 * | 2/2012 | Guntert et al. | 404/104 |
| 2003/0194272 | A1 * | 10/2003 | Smith | 404/75 |
| 2006/0117678 | A1 * | 6/2006 | Neighbours | 52/125.1 |
| 2010/0219651 | A1 | 9/2010 | Walter et al. | |

FOREIGN PATENT DOCUMENTS

| | | | |
|---|---|---|---|
| DE | 3312416 | A1 | 4/1983 |
| EP | 0139827 | A2 | 5/1985 |
| JP | 2004285689 | | 10/2004 |

OTHER PUBLICATIONS

Sales Literature and Operation Instructions for the Porta-Puller Part# (PP-002).

* cited by examiner

*Primary Examiner* — Raymond W Addie
(74) *Attorney, Agent, or Firm* — Erickson, Kernell, Derusseau & Kleypas, LLC

(57) ABSTRACT

A slab jack assembly for raising a fragmented slab from between sections of a concrete slab from which the fragmented slab is cut comprises a planar support positionable on top of the fragmented slab. Jacks are mounted on opposite sides of the planar support to engage an upper surface of the concrete slab. Securement pins mounted on the planar support are insertable into holes bored in the plurality of fragments in the fragmented slab and expandable within the holes to secure the fragments to the planar support. The first and second jacks are then operable to lift the planar support and fragments upward relative to the concrete slab.

26 Claims, 14 Drawing Sheets

FRAGMENTED SLAB LIFTING APPARATUS AND METHOD

FIELD OF THE INVENTION

The present invention is directed to a lifting device used in the repair of concrete roads which lifts out damaged sections of the concrete that have been cut from the surrounding road.

BACKGROUND OF THE INVENTION

Referring to the section of road shown in the drawings, a common practice for repairing damaged sections of concrete slabs 2 forming the road is to cut out and remove a damaged section 3 and pour a concrete patch in the remaining hole. The area around lateral control joints 5 formed in the slabs 2 which have degraded over time are areas that are commonly in need of repair. The concrete slab 2 forming a road is typically poured as a generally continuous slab. The slab may be approximately nine to twelve inches thick. Saw cuts are then cut into the slab 2, commonly about one third of the thickness of the pavement, to provide an area of weakness at which cracks will naturally form in the slab 2. Longitudinal joints 6 are formed longitudinally along the slab 2 to separate lanes that are typically twelve feet wide. Lateral control joints 5 are formed laterally across the slab 2 typically approximately fifteen feet apart.

Damage at the lateral control joints 5, typically starts with chipping and spawling of the edges of the joint 5, forming a small depression which then grows as tires continuously pound against the defect and water seeps into the cracks therein and freezes further expanding the defects. Over time cracks will also form extending outward from the joint 5. In addition, cracks may form across the slab between control joints 5 which is more common when the spacing between control joints 5 is increased, such as for example thirty foot spacings.

A typical procedure for repairing a slab having a degraded control joint 5 is to cut out and remove a specified amount of the concrete slab 2 on either side of the degraded joint 5. The width of the slab to be removed may vary depending on specifications established by the jurisdiction in charge of the road repair. Typically, the jurisdiction or owner will specify removing at least two to three feet of the concrete slab 2 on either side of the joint 5 and in some cases up to approximately five feet on either side of the joint 5. The portion of the slab 2 removed may be referred to as the damaged section or fragmented section 3. The fragmented section 3 typically includes at least two fragments 9, but may further fragment into additional fragments 9 due to cracks radiating outward from the joint 5.

In repairs, cuts 11 are made through the concrete slab outward from the crack on both sides the distance specified. Holes 13 are then drilled in the fragmented section 3 to be removed with at least one hole 13 per fragment 9 to be removed. Expansion pins are then inserted into the holes and expanded to lock the pins in the holes. The holes 13 are drilled to a size adapted to receive a non-expanded pin which is typically between two to three inches in diameter. After the pins are inserted in the hole 13, the pins are expanded until the diameter of the pin equals the diameter of the hole 13 in which it is inserted wedging the pin in place and securing the slab to the pin. The pins are connected together by a harness that is then lifted with an excavator or the like to lift the pins and the fragmented section 3 connected thereto from the rest of the concrete roadway or slab 2.

Great care must be taken when lifting the damaged section 3 so as not to chip the edges of the concrete slab 2 on either side of the damaged section 3 as it is lifted. Roadway repair specifications or guidelines often specify that if the edge of the slab adjacent the removed damaged section 3 is chipped or spalled, the contractor has to make another cut to remove the damaged edge and create a new clean edge. Lifting a cracked and fragmented section 3 using a harness connected to locking pins without the load shifting and causing damage to the edge remaining slab is very difficult requiring additional labor to help guide the damaged section from between the adjacent sections of the remaining slab and at a very slow pace. Even then, the crew may not be able to prevent damage due to shifting of the load.

It is known to bolt frames to sections of a fragmented slab to stabilize the fragments prior to lifting the fragments from the road. See for example, U.S. Pat. No. 7,448,176 to Drake and U.S. Pat. No. 6,752,566 to Smith. However, the system disclosed in the Smith '566 patent relies on the use of cables or straps connected between the frame and an overhead crane or the like for lifting the stabilized slab from the adjacent sections of the concrete road which, as discussed, can still result in damage to the edges of the adjacent road. The Drake '176 patent appears to be silent on how the stabilized slabs are lifted from the concrete road.

There remains a need for a system for stabilizing and removing damaged and fragmented sections of a concrete slab in an efficient manner without damaging the edges of the slab adjacent to the sections removed. There further remains a need for such a system which can be operated by a minimal number of operators to reduce the labor costs in repairing damaged roads and slabs.

SUMMARY OF THE INVENTION

A slab lifting apparatus or slab jack assembly is disclosed for raising a fragmented slab upward and out from between sections of a concrete slab from which the fragmented slab is cut. The fragmented slabs with which the slab lifting apparatus is used typically include a plurality of fragments. The slab lifting apparatus comprises a planar support positionable on top of the fragmented slab. At least two jacks are mounted on opposite sides of the planar support and positioned such that a base of each of the jacks engages an upper surface of the concrete slab. A first jack engages the upper surface of the concrete slab on a first side of the fragmented slab and a second jack engages the upper surface of the concrete slab on a second side of the fragmented slab. A plurality of securement pins mounted on the planar support are insertable into holes bored in the plurality of fragments in the fragmented slab and expandable within the holes to secure the plurality of fragments to the planar support. The first and second jacks are then operable to lift the planar support and the plurality of fragments secured thereto upward relative to the concrete slab. In one embodiment, the slab lifting apparatus includes four jacks, two on each side of the planar support. The jacks provide controlled lifting of the fragmented slab out from between adjacent sections of the concrete slab and securement of the fragmented slab against the planar support stabilizes the fragments so they are less likely to shift upon lifting. Therefore there is less risk of damage to the edges of the adjacent sections of the concrete slab from which the fragmented slab is removed.

The securement pins used preferably comprise wedge pins which are expandable upon drawing a portion of the wedge pin toward the planar support to draw the fragments of the fragmented slab toward the planar support upon expansion of the wedge pins in the plurality of holes formed in the fragments. The planar support may comprise a support frame having a load securement member moveably mounted relative to the support frame and extendable in parallel planar alignment below the support frame and into engagement with the fragmented slab secured to said planar support by the securement pins. The load securement member is adapted to span cracks between adjacent fragmented sections of the slab to fix their horizontal alignment against the load securement member.

The slab lifting apparatus may include a lift connector connected to the support frame for coupling of a connector on the end of an excavator arm or the like which can be used to move the slab lifting apparatus with or without a fragmented slab connected thereto relative to the concrete slab from which the fragmented slab is cut. The lift connector may be mounted on a lift column. The lift column may be supported on a base which is laterally moveable relative to the support frame to permit adjustment to the center of gravity of the planar support and the fragmented slab attached thereto relative to the lift connector to accommodate variations in the center of gravity of the fragmented slab lifted by the slab lifting apparatus.

Alternatively, a mobile lifting frame may be used with the slab lifting apparatus. The slab lifting apparatus may include a telescoping assembly for connecting the slab lifting apparatus to the mobile lifting frame and then raising the slab lifting apparatus and an attached fragmented slab relative to the mobile lifting frame so that the fragmented slab can be moved by the lifting frame over the bed of a truck and then released onto the truck bed.

The telescoping assembly preferably is rotatably mounted on the lifting frame to permit rotation of the slab lifting apparatus and the attached fragmented slab lifted above the concrete slab from which the fragmented slab was cut. Rotation of the slab lifting apparatus facilitates proper positioning of the slab lifting apparatus by itself or with a fragmented slab attached. In an embodiment using a lift connector the lift connector may be pivotally connected relative to the planar support of the slab lifting apparatus to similarly permit pivoting of the slab lifting apparatus and the attached fragmented slab relative to an excavator or the like used to lift the slab lifting apparatus.

DETAILED DESCRIPTION OF THE PREFERRED EMBODIMENTS

Figure 1:
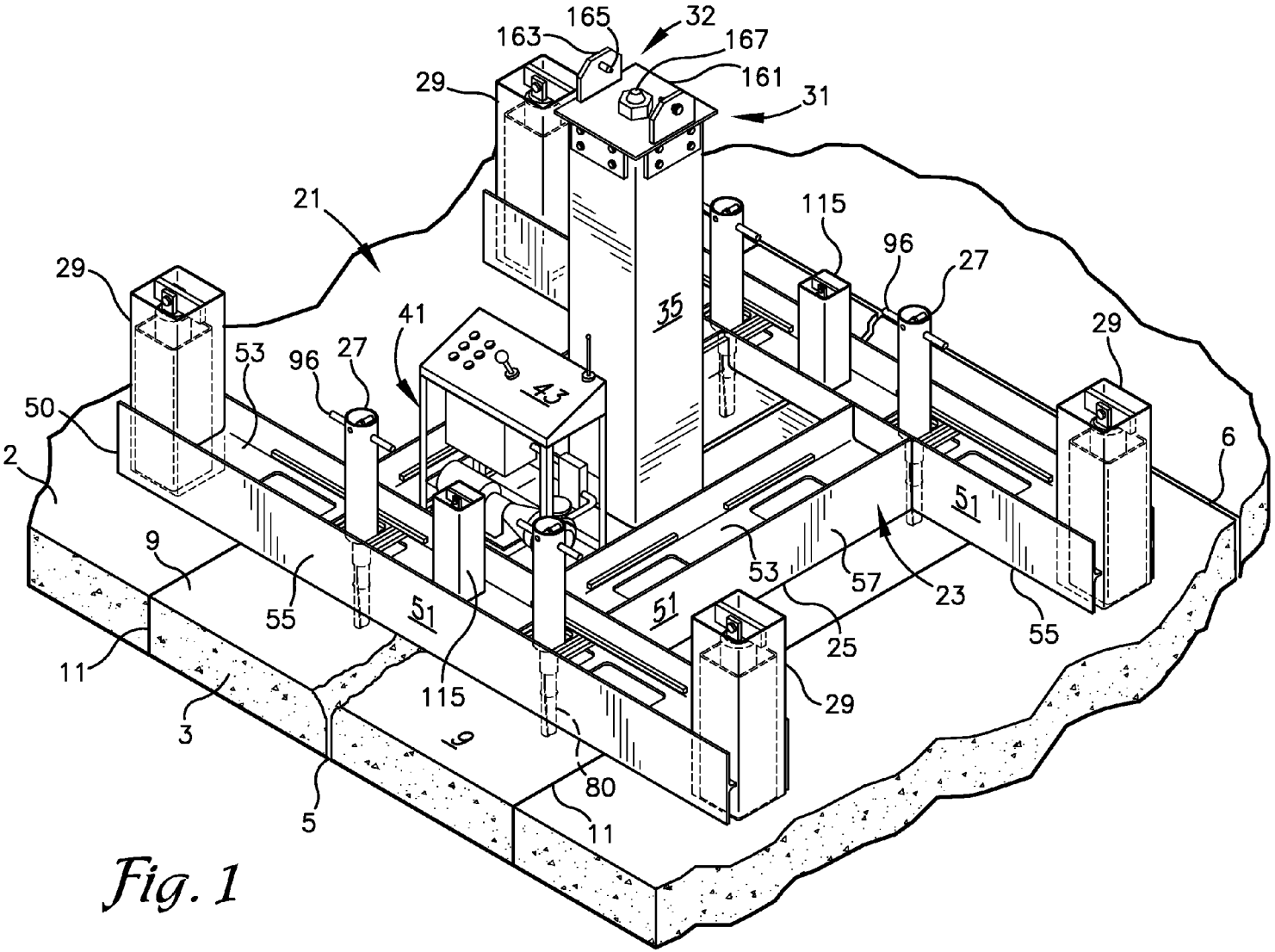
FIG. 1 is a perspective view of a slab jack for lifting a fragmented slab out from between adjacent sections of the remaining slab from which the fragmented slab is cut with the view of the remaining slab being fragmentary.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. The drawings constitute a part of this specification and include exemplary embodiments of the present invention and illustrate various objects and features thereof.

Certain terminology will be used in the following description for convenience in reference only and will not be limiting. For example, the words "upwardly," "downwardly," "rightwardly," and "leftwardly" will refer to directions in the drawings to which reference is made. The words "inwardly" and "outwardly" will refer to directions toward and away from respectively, the geometric center of the embodiment being described and designated parts thereof. Said terminology will include the words specifically mentioned, derivatives thereof and words of a similar import.

Referring to the drawings in more detail, the reference number 21 generally designates a slab lifting apparatus for raising a fragmented section or fragmented slab 3 of concrete cut out from between sections of a larger concrete slab 2 from which the fragmented slab 3 is cut, such as in a road, runway or parking lot. The fragmented slab 3 may also be referred to as a patch and the slab lifting apparatus 21 may also be referred to as a patch puller, a slab jack or a slab jack assembly. The slab jack assembly 21 includes a frame 23 having a bottom edge 25 forming a planar support. A plurality of wedge pin assemblies or securement pins 27 mounted on the frame 23 and insertable in holes 13 drilled in the fragmented section 3 of slab 2 to secure the fragmented section 3 to frame 23. A plurality of jacks 29 are connected to the frame 23 and positioned to engage an upper surface of the slab 2 on opposite sides of the fragmented section 3. The jacks 29 are operable to lift the frame 23 and attached fragmented section 3 upward relative to the remaining portion of the slab 2.

A secondary lifting assembly 31, including a lift connector or clevis 32, is mounted on the frame 23 to permit connection to a coupler on the end of a boom arm of an excavator or other lifting equipment to permit further lifting of the frame 23 and the connected, fragmented slab section 3 away from the remaining portion of the slab 2 in a secondary lifting step. The secondary lifting step is done after the jacks 29 have lifted the fragmented slab section 3 out from the remaining slab 2 far enough to avoid damage to the remaining slab 2. The frame 23 and fragmented section 3 are lifted and moved in the secondary lifting step to a temporary storage area or a truck for transport to a disposal site. In the embodiment shown, the lift connector or clevis 32 is mounted on a lifting column 35 which may be used in conjunction with a mobile lifting frame as an alternative means for implementing the secondary lifting step as discussed hereafter.

Figure 5:
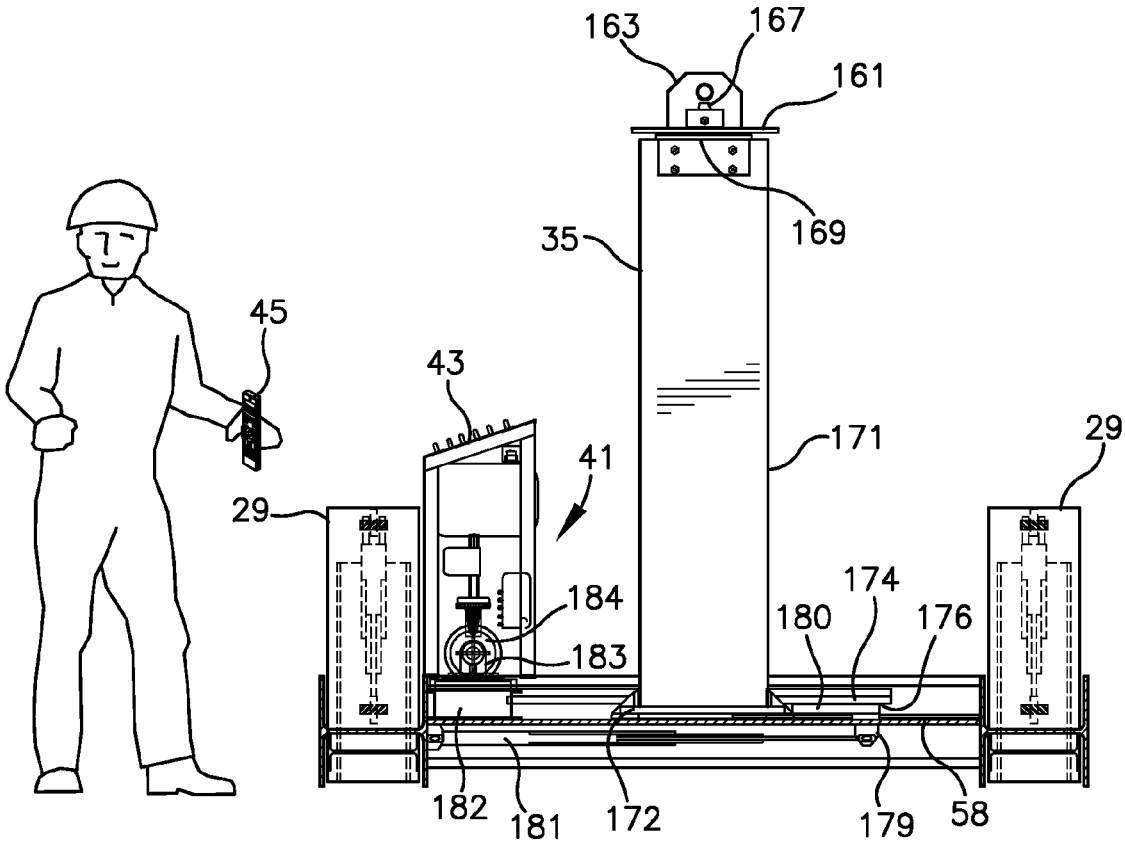
FIG. 5 is a cross-sectional view taken along line 5-5 of FIG. 2 and showing an operator.

As best seen in FIG. 5, a hydraulic fluid supply assembly 41 is integrated into the slab lifting apparatus to supply hydraulic fluid under pressure to hydraulic actuators associated with the jacks 29 and additional hydraulically operated assemblies discussed hereafter. A control panel 43 is mounted to the frame 23 from which the hydraulic fluid supply assembly 41 may be operated and a hand held remote control 45 may be utilized to operate the control panel 43.

In the embodiment shown, the frame 23 is formed from a plurality of I-beams or H-beams 50 with outer flanges 51 oriented vertically and the interconnecting web 53 extending horizontally between the flanges 51. Two parallel extending H-beams 50 form spaced apart legs or longitudinal legs 55 of the frame 23 which are secured together in spaced relation by transverse cross-beams 57. Cross beams 57 extend in parallel spaced relation. A support panel or floor 58, for supporting the lifting column 35 thereon is welded to and extends between the longitudinal legs 55 and transverse cross-beams 57. Lower edges 25 of the flanges 51 of the beams 50 forming the longitudinal legs 55 and transverse cross-beams 57 extend in planar alignment to form the planar support against which the fragmented sections 3 of concrete may be drawn for securing in place prior to removal.

In a preferred embodiment, the longitudinal legs 55 are preferably approximately ten feet long and the legs 55 are spaced apart by the cross-beams 57 such that the frame 23 is approximately eight feet wide as measured from the outer flanges 51 of the longitudinal legs 55. The outer flanges 51 of the H-beams 50 forming the transverse cross-beams 57 are spaced approximately 4 feet apart. The jacks 29 are mounted on distal ends of the legs 55 and adapted to be supported on an upper surface of the concrete slab 2 adjacent the fragmented section 3 to be removed.

Figure 6:
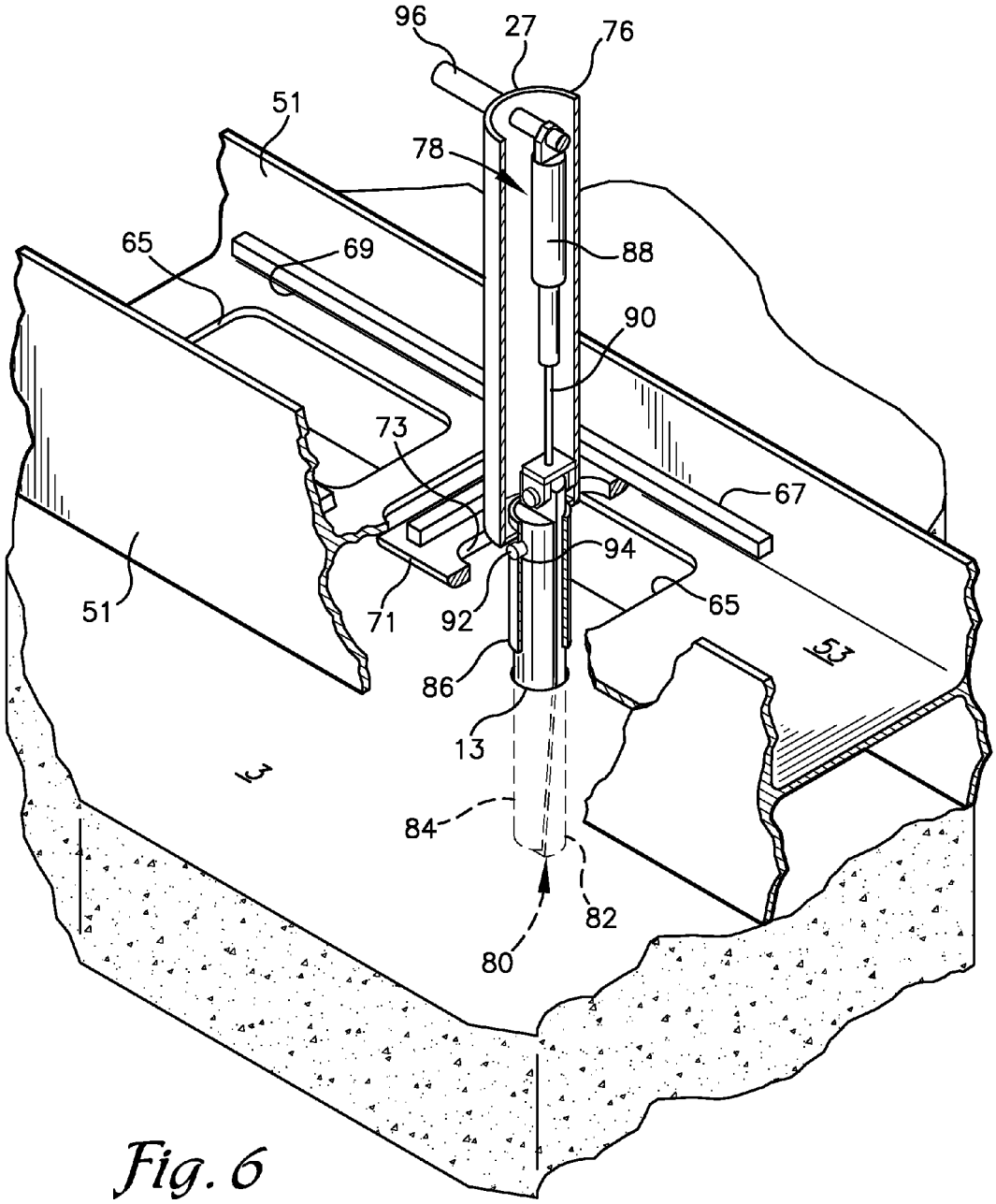
FIG. 6 is an enlarged and fragmentary view of the slab jack assembly with portions removed to show details of an expandable securement pin extending into a hole in the fragmented slab for securing the fragmented slab to the slab jack assembly.

A plurality of pin access openings 65 are formed through the web 53 of the H-beams 50 forming frame 23. Each pin access opening 65 is rectangular, extending lengthwise along a longitudinal axis of the web 53 of the H-beam 50 in which it is formed. As best seen in FIG. 6, guide rails 67 are welded to or otherwise formed on the inner surface of each flange 51 in space relation above the web 53 along each pin access opening 65 forming a guide slot 69 between the web 53 and the rails 67. Pin support plates 71 may be slidably positioned over selected pin access openings 65 within the guide slots 69.

Each pin support plate 71 has an elongate slide plate opening 73 extending therethrough. Each slide plate opening 73 is oriented with a longitudinal axis extending transverse to a longitudinal axis of the pin access opening 65 formed in the web 53 over which the slide plate 71 is positioned. The pin access opening 65 is longer than the width of the slide plate opening 73 and in the embodiment shown the pin access opening 65 is approximately five times greater than the width of the slide plate opening 73.

As best seen in FIG. 6, each securement pin 27 comprises a cylindrical housing 76 with a hydraulic, linear actuator 78 mounted therein. The cylindrical housing 76 extends vertically relative to the pin support plate 71 and is larger in diameter than the slide plate opening 73. The actuator 78 cooperates with an expansion pin assembly 80 which extends through the slide plate opening 73 when the cylindrical housing 76 is supported on pin support plate 71. The expansion pin assembly 80 includes moveable pin section 82 and a stationary wedge section 84 secured within an expansion pin collar 86.

The expansion pin collar 86 is secured, by welding or the like, in axial alignment within the cylindrical housing 76 at a lower end thereof with the collar 86 extending below cylindrical housing 76. The actuator 78 includes an actuator cylinder 88 connected at an upper end to an upper end of the cylindrical housing 76 and a piston 90 extending downward and connected at a distal end to an upper end of the moveable pin section 82 which is slidably mounted within collar 86. The stationary wedge section 84 is connected to expansion pin collar 86 to fix the vertical orientation of wedge section 84 relative to collar 86. In the embodiment shown, a cylindrical stud 92 is fixedly secured to or formed on an upper end of the wedge section 84 and projects outward therefrom. Stud 92 is sized to be received in a stud receiving bore 94 formed in collar 86 thereby fixing the position of the wedge section 84 relative to collar 86. Retraction of piston 90 draws the moveable pin section 82 upward across the widening wedge section 84 increasing the overall diameter of the expansion pin assembly 80.

The expansion pin assembly 80, with the moveable pin section 82 fully extended relative to the wedge section 84, has a diameter that is smaller than the holes 13 drilled in the fragmented slab section 3 and smaller than the pin access opening 65 in the web 53 of frame members 50 and smaller than the slide plate opening 73 in pin support plates 71. The cylindrical housing 76 for securement pin assemblies 27 is greater than the width of the slide plate opening 73 in the pin support plates 71 such that the cylindrical housing 76 may be supported on the pin support plate 71 with the cylindrical housing 76 abutting the pin support plate 71 and the expansion pin assembly 80 extending through the slide plate opening 73 in support plate 71, then through the pin access opening 65 in the frame web 53 and into one of the holes 13 drilled in the fragmented slab 3.

The slide plate opening 73 is just wider than the diameter of the expansion pin assembly 80 in a retracted position and roughly four times as long as the diameter of the retracted expansion pin assembly 80. The pin support plate 71 may be slid in the guide slots 69 relative to the pin access opening 65 and the securement pin 27 may be slid or positioned relative to the slide plate opening 73 until the expansion pin assembly 80 is positioned over a hole 13 in a slab fragment 9. The expansion pin assembly 80, with the moveable pin section 82 extended relative to the stationary wedge section 84 may then be inserted into the aligned hole 13. Handles 96 are secured to the cylindrical housing 76 near an upper end thereof to facilitate lifting and positioning the securement pin assemblies 27. A plurality of securement pin assemblies 27 are positioned in a plurality of holes 13 bored into the multiple fragments 9 in the fragmented section 3 to be removed. Hydraulic fluid is supplied to the actuator 78 in each pin assembly 27 through hoses (not shown) connected to the hydraulic fluid supply assembly 41.

Subsequent drawing of the moveable pin section 82, of each securement pin assembly 27, upward against the widening wedge section 84 increases the diameter of the expansion pin assembly 80 to the size of the hole 13 in which it is received wedging the pin assembly 80 in the hole 13. As the moveable pin section 82 is being drawn upward, and wedged into hole 13 it also pulls the fragment 9 to which it is attached upward toward the bottom edge 25 of frame 23 which may also be referred to as the planar support. Abutment of the fragments 9 against the bottom edge 25 of frame 23 helps prevent shifting of the fragments 9 as the fragmented slab 3 is subsequently lifted as described in more detail hereafter.

Figure 3:
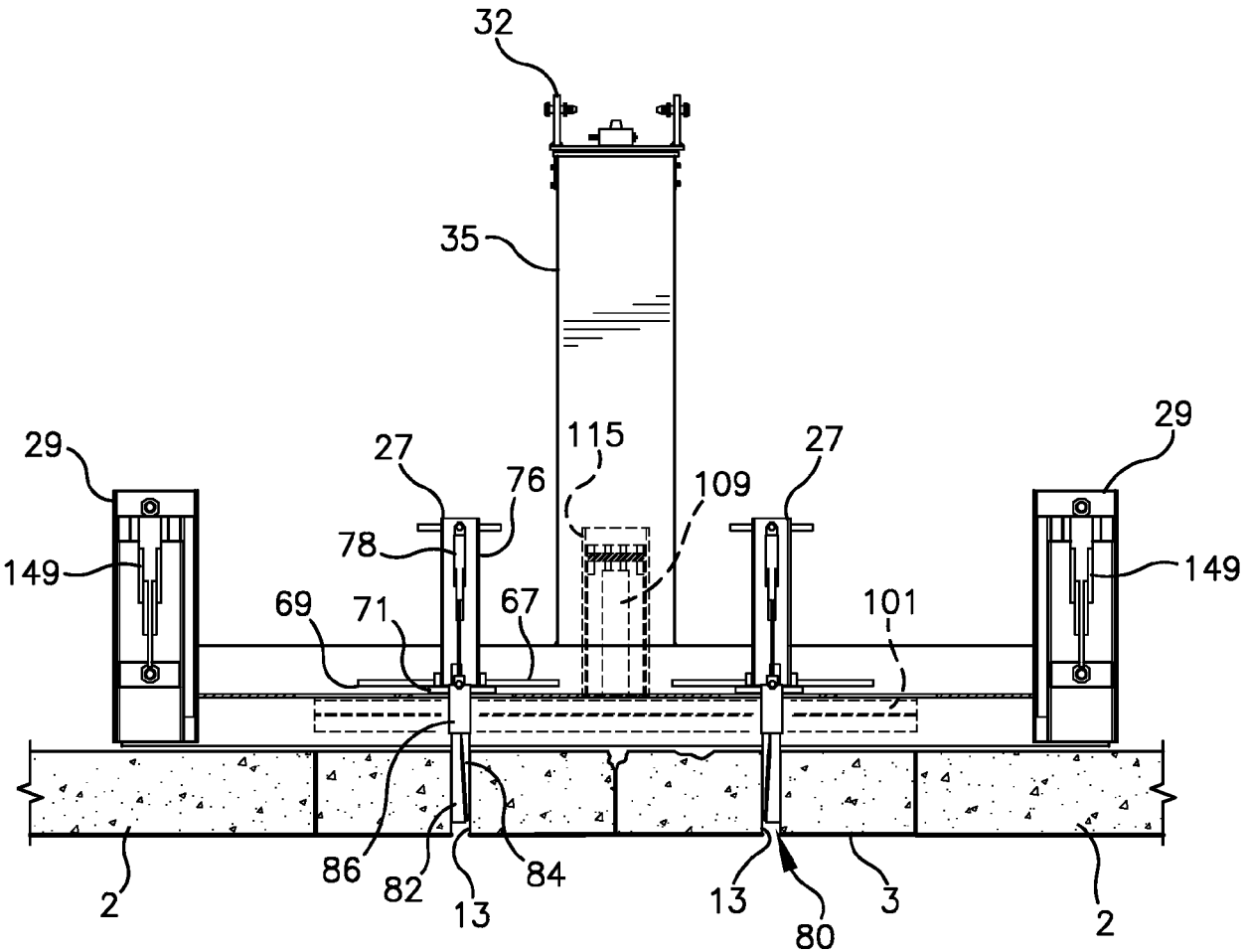
FIG. 3 is cross-sectional view taken along line 3-3 of FIG. 2 showing expandable securement pins mounted on the slab jack and extending into holes in the fragmented slab to be removed.
Figure 4:
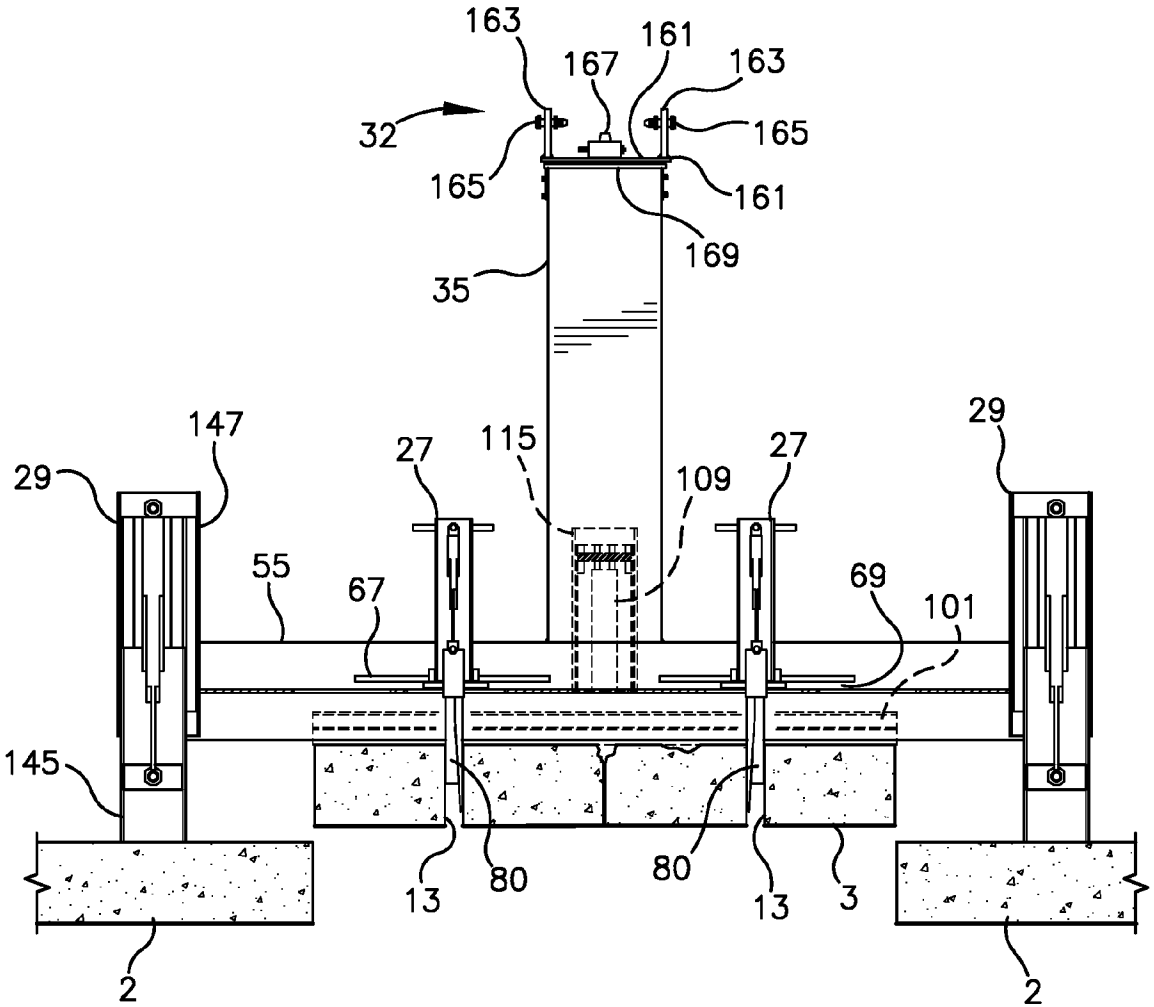
FIG. 4 is a view similar to FIG. 3 showing jacks on the slab jack raised to lift the fragmented slab connected to the securement pins out from between and above the adjacent sections of the remaining slab.
Figure 7:
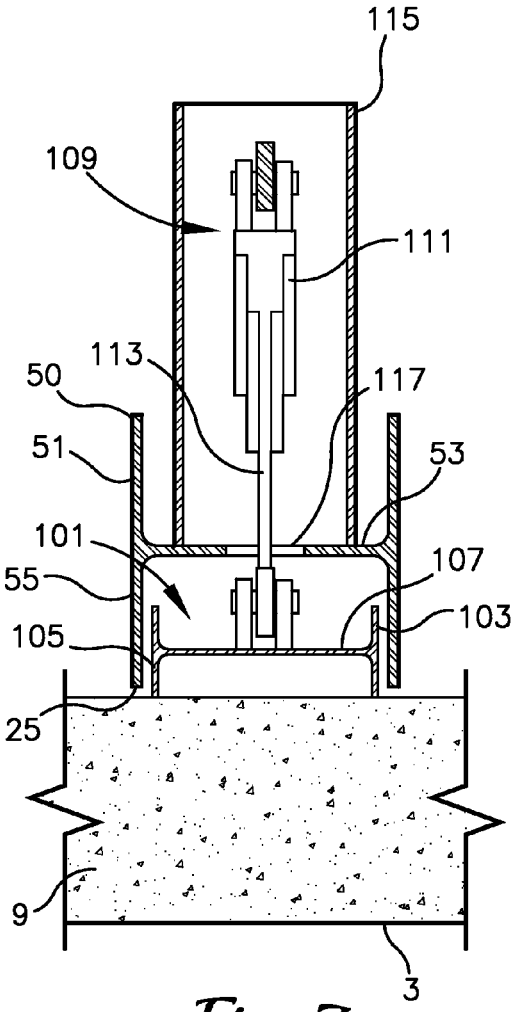
FIG. 7 is an enlarged and fragmentary cross-sectional view taken along line 7-7 of FIG. 2 showing details of a load securement member for pressing against a plurality of fragments connected to the slab jack to fix the position of the fragments relative thereto.

The fragments 9 are further secured from shifting by load securement members or pans 101 located within the beams 50 forming the longitudinal legs 55 of the frame 23. The pans 101, shown in phantom lines in FIGS. 3 and 4 and in cross-section in FIG. 7, are generally formed from H-beams 103 having vertically extending flanges 105 with a connecting web 107. The flanges 105 are spaced more narrowly than the flanges 51 forming the H-beam 50 of frame 23 and the flanges 105 are shorter than the lower half of each of the flanges 51 so that the H-beam 103 forming load securement member 101 fits within the space extending below web 53 and within the lower half of flanges 51. As shown in FIGS. 3 and 4, the pans 101 are sized to have a length approximately equal to the width of a fragmented slab 3 to be removed using the slab lifting apparatus 21 so that the pans 101 generally extend across the fragmented slab 3.

Each load securement member or pan 101 is mounted at a center thereof to a linear actuator 109 connected to H-beam 50 of frame 23. The actuator 109, in the embodiment shown, is a hydraulic actuator having a cylinder 111 and a piston 113. The cylinder is connected at an upper end to a tubular housing 115 welded to the web 53 of the H-beam 50 forming one of the longitudinal legs 55 of frame 23 around an opening 117 through the web 53. The actuator piston 113 extends through the opening 117 and is connected at a distal end to the load securement member 101 preferably at a center thereof.

After the fragmented slab 3 is secured to the frame 23 using securement pins 27, the pans 101 can be driven downward by actuator 109 to advance the pans 101 past a bottom edge 25 of the frame 23 and into contact with the fragmented slab 3 generally transverse to a joint 5 to be repaired. Abutment of the pans 101 against adjacent fragments 9 functions to generally secure the fragments 9 against the pans 101 so that they are stabilized when lifted.

Figure 2:
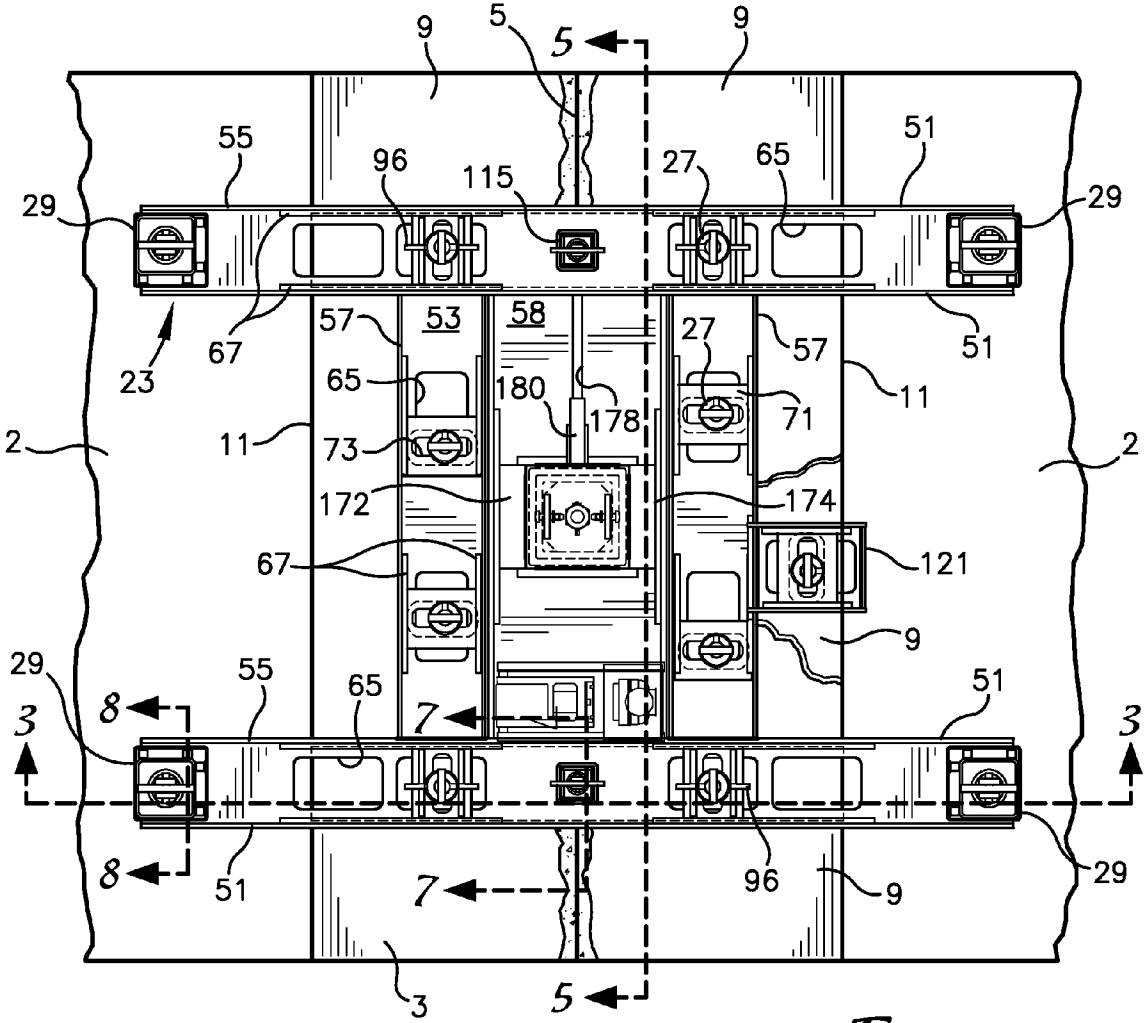
FIG. 2 is a top-plan view of the slab jack as in FIG. 1 supported on the slab and across the fragmented slab to be removed and having an auxiliary securement pin mount connected thereto.
Figure 9:
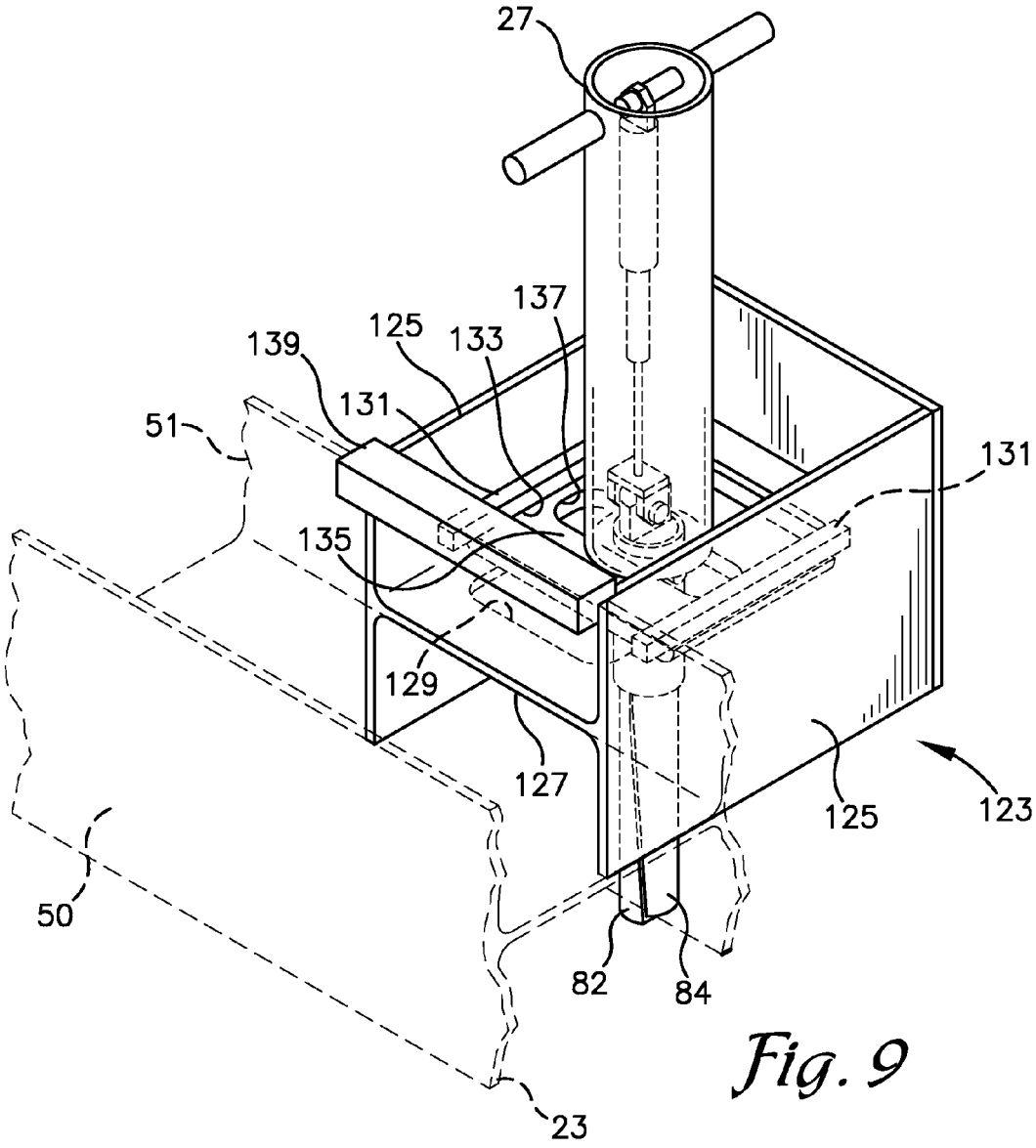
FIG. 9 is an enlarged, perspective view of an auxiliary securement pin mount connectable to a frame member of the slab jack shown in phantom lines.
Figure 10:
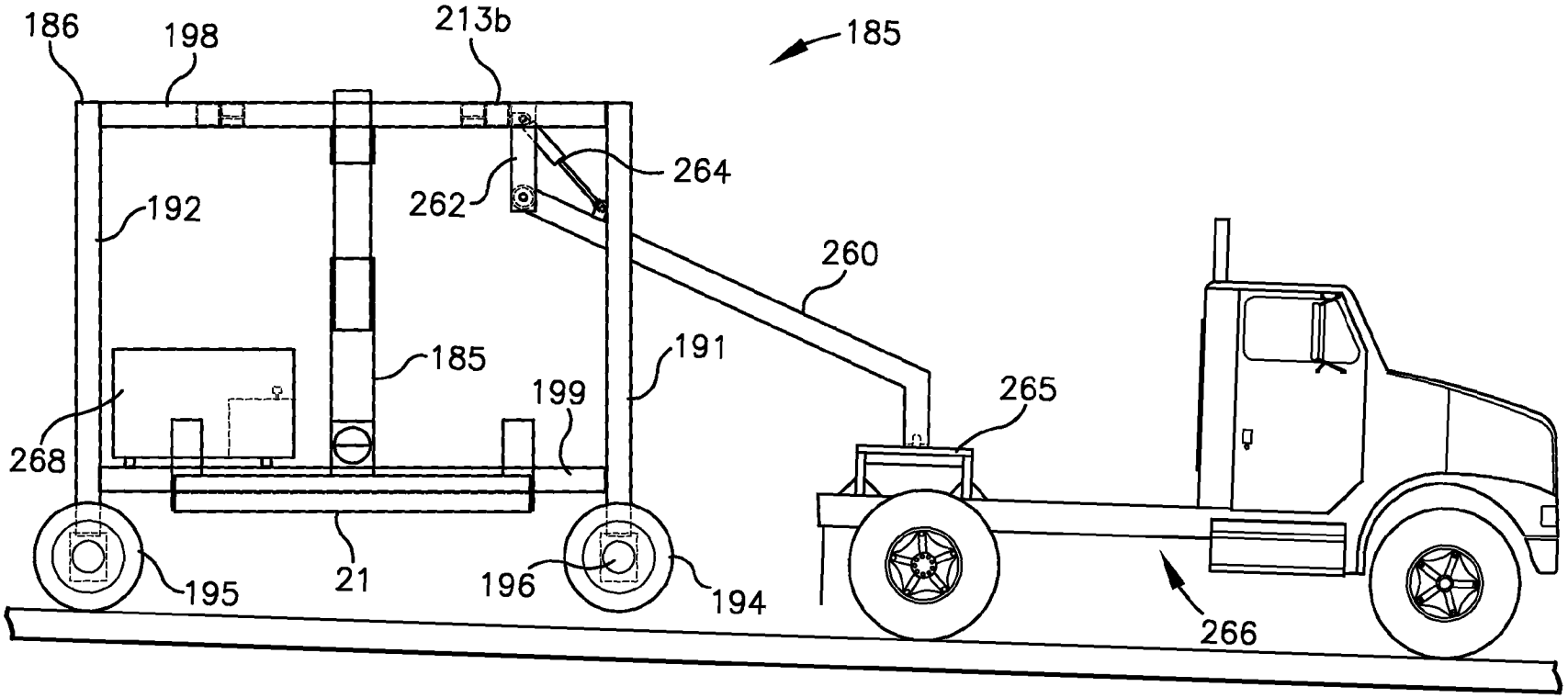
FIG. 10 is a partially diagrammatic, side view of a mobile lifting frame connected to and towed by a truck.

It is to be understood that the holes 13 into which the expansion pin assemblies 80 of securement pins 27 are to be inserted are preferably drilled into the fragmented slab 3 in a pattern or spacing which will align with selected pin access openings 65 in frame 23. In circumstances in which a fragment 9 forms in a slab 3 such that a hole 13 cannot be drilled to align with an access opening 65 in the frame 23, auxiliary securement pin mounts 121 (see FIGS. 2 and 9) are provided to facilitate aligning a securement pin 27 with a hole 13 drilled in such a fragment 9.

Each auxiliary securement pin mount 121 comprises a relatively short section of an H-beam 123 including a pair of vertically extending flanges 125 separated by a web 127 with a pin access opening 129 extending therethrough. Guide rails 131 are welded to or otherwise formed on the inner surface of each flange 125 in spaced relation above the web 127 and spanning the pin access opening 129 to form a guide slot 133 between the web 127 and the rails 131.

A pin support plate 135, slidably mounted within the guide slots 133 may be slidably positioned over the pin access opening 129. The pin support plate 135 has an elongate slide plate opening 137 extending therethrough. Each slide plate opening 137 is oriented with a longitudinal axis extending transverse to a longitudinal axis of the pin access opening 129 formed in the web 127 over which the pin support plate 135 is positioned. The pin access opening 129 is longer than the width of the slide plate opening 137 and in the embodiment shown the pin access opening 129 is approximately five times greater than the width of the slide plate opening 137.

An elongated hook 139 extends between the flanges 125 of the H-beam section 123 across an upper end thereof. The hook 139 may be supported on one of the flanges 51 of an H-beam 50 forming the frame 23 to permit selective positioning of the auxiliary securement pin mounts 121 relative to the frame 23 to align with a hole 13 bored in a fragment 9 at a location that does not normally align with one of the access openings 65 in the frame 23. When an expansion pin assembly 80, inserted in the hole 13 through the slide plate opening 137 in pin support plate 135 and pin access opening 129 in web 127 of the auxiliary pin mount 121, is expanded by drawing the moveable pin section 82 upward, the auxiliary pin mount 121 is drawn down against the fragment 9 in which the hole 13 is bored securing the fragment 9 to the auxiliary pin mount 121 and frame 23.

Figure 8:
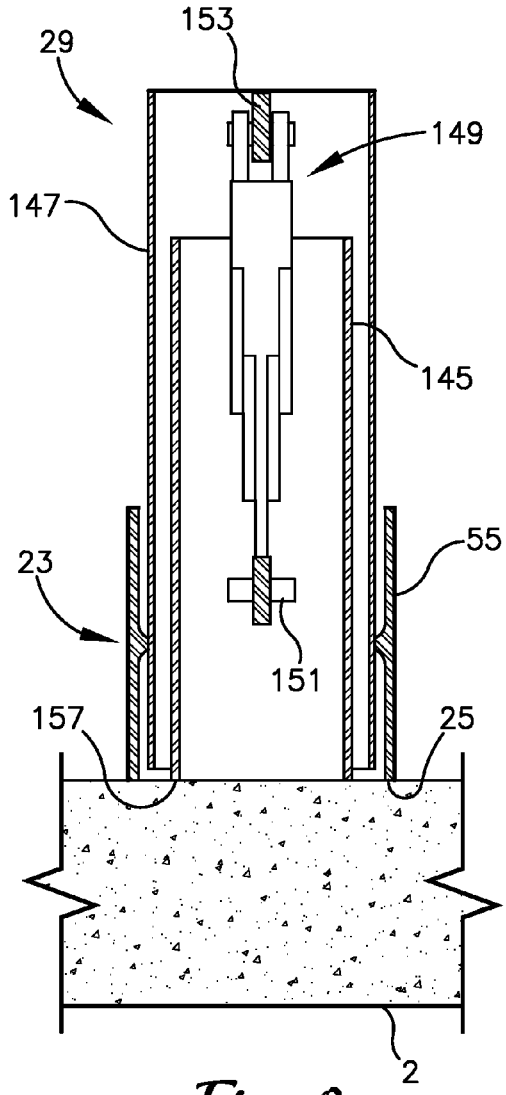
FIG. 8 is an enlarged cross-sectional view taken along line 8-8 of FIG. 2 showing details of one of the jacks mounted on ends of legs forming the slab jack.

Once the fragmented slab 3 is secured to the frame 23 using the securement pins 27 alone or in combination with the load securement pans 101, the jacks 29 are actuated to raise the frame 23 and the fragmented slab 3. Referring to FIG. 8, each jack 29 includes a jack base 145 and a load bearing member 147 moveable vertically relative to one another via a jack actuator, which in the embodiment shown is a hydraulic actuator 149. The jack base 145 shown comprises a square tube positioned within a larger square tube forming the load bearing member 147 which is welded to one end of frame leg 55. A lower end of the actuator 149 is connected to a mount 151 welded to an interior of the jack base 145 and an upper end of the actuator 149 is connected to a mount 153 welded to an interior of an upper end of the load bearing member 147. Extension and retraction of the actuator 149 raises and lowers the load bearing member 147 and the attached frame 23 relative to the jack base 145.

A lower edge 155 of the load bearing member 147 extends proximate and slightly above the bottom edge 25 of frame 23. The structure including the lower edge 157 of the jack base 145 may be referred to as a foot of the jack 29. The foot of the jack is supported on an upper surface of the remaining slab 2 from which the fragmented slab is cut. The jack 29 preferably has a lifting stroke which is longer than the height of a fragmented slab 3 to be lifted such that when the lift actuator 149 is fully extended raising the load bearing member 147 to its highest alignment relative to the jack base 145, a bottom edge of the fragmented slab 3 is lifted above an upper edge of the remaining slab 2. Once the fragmented slab 3 is lifted above the remaining slab 2 it can be further lifted using the secondary lift assembly 31 without impinging against the remaining slab 2 to avoid damaging the edges of the remaining slab 2.

Operation of the lift actuators 149 may be controlled independently from the control panel 43 which controls the hydraulic fluid supply assembly 41. Hydraulic fluid may be supplied independently to the actuators 149 to allow an operator to independently extend and retract each actuator 149 to gradually raise the frame 23 and attached fragmented slab 3.

Referring to the secondary lift assembly 31 as shown in FIGS. 1-5, the clevis 32 comprises a base plate 161 with a pair of clevis plates 163 projecting upward therefrom on opposite sides of the base plate 161 and with clevis pins 165 extending through holes in the clevis plates 163. The base plate 161 is rotatably mounted on a stub axle 167 secured to and projecting upward from a bearing plate 169 bolted or otherwise removably secured on an upper end of lifting column 35. The lifting column 35 and frame 23 connected thereto may be rotated about the stub axle 167 relative to the clevis 32.

The lifting column 35 is preferably slidably mounted on the support panel 58 to permit adjustment of the center of gravity of the patch puller 21 and attached fragmented slab 3. The lifting column 35 comprises a square tube 171 welded to a rectangular base plate 172. The column base plate 172 is supported for sliding movement on the horizontal support panel 58 welded between the frame legs 55 and cross-beams 57. Guide rails 174 are welded to surfaces of the vertical flanges 51 of the cross-beams 57 which face inward toward the horizontal support panel 58 in spaced relation above the support panel 58 to form a guide channel 176 there across. The ends of the lifting column base plate 172 extend into the guide channels 176 with the guide rails 174 holding the base plate 172 in a planar sliding alignment with the support panel 58.

A slot 178 is formed through the support panel 58 extending in parallel relation to and medially between the cross-beams 57 and transverse to legs 55. An ear 179, mounted on an extension arm 180 connected to the lifting column base plate 172 extends though the slot 178. The extension arm 180 spaces the ear 179 outward from the lifting column 35. A hydraulic actuator 181 is connected at one end to the ear 179 and at an opposite end to one of the cross-beams 57 or to the bottom of the support panel 58 by a clevis or the like. Extension and retraction of the hydraulic actuator 181 moves the lifting column 35 and base plate 172 laterally relative to the longitudinal legs 55 of the frame 23. The guide slot 178 extends only partially across the horizontal support panel 58 and in the embodiment shown the guide slot 178 is approximately two feet or twenty-four inches long to allow the column 35 to shift up to a foot relative to the frame 23 in opposite directions. The length of the extension arm 180 and the length of the guide slot 178 are selected to maximize the stroke of the actuator 181 and the attached column 35.

The hydraulic actuators 78 for the securement pins 27, actuators 149 for jacks 29, actuators 109 for the load securement members 101 and the actuator 181 for lateral movement of the lift column 35 are connected by hoses (not shown) to the hydraulic fluid supply assembly 41. As seen in FIGS. 1 and 5, the hydraulic fluid supply assembly 41 includes a hydraulic fluid reservoir 182, a pump 183 and an engine, such as a gasoline engine 184 for supplying power to the pump 183. The reservoir 182, pump 183 and engine 184 are shown mounted on the horizontal support panel 58. The control panel 43 includes controllers for controlling the operation of the pump and valves (not shown) to control the delivery of hydraulic fluid under pressure to the hydraulic actuators utilized in the slab lifting apparatus or patch puller 21.

A coupler on an arm of an excavator or the like (not shown) may be selectively coupled to the clevis 32 to use the excavator to lift the slab lifting apparatus 21 with a fragmented slab 3 attached thereto away from where it was cut out of the road bed slab 2 and to position the removed fragmented slab 3 on a truck or other transport vehicle. Once the fragmented slab 3 is positioned on a truck or at another disposal site, the load securement pans 101 may be retracted back into the frame 23 and the moveable pin section 82 of the expansion pin assemblies 80 may be extended to reduce the diameter of the pin assemblies 80 relative to holes 13 so that the pin assemblies 80 may be withdrawn from the holes 13 separating the slab 3 from the lifting apparatus 21. The excavator then moves the lifting apparatus over a section of the slab 2 from which the next fragmented slab 3 is to be removed.

As an alternative to using an excavator, a mobile crane or lifting frame 185, as shown in FIGS. 10-18, may be used in cooperation with the lift column 35 to lift the patch puller 21 and an attached fragmented slab 3 away from the portion of the slab 2 from which it was removed. The patch puller 21 shown in FIGS. 10-18 has had detail removed for purposes of clarity. The mobile lifting frame 185 generally comprises a framework 186 including a central support frame 187 and left and right side frame assemblies 188 and 189 which are telescopically connected to the central support frame 187 and support the central support frame 187 above the ground. The left and right side frame assemblies 188 and 189 telescope laterally relative to the central support frame 187 and to one another.

Each of the frame assemblies 188 and 189 includes front and rear vertical frame members or legs 191 and 192 with front and rear wheels 194 and 195 respectively mounted to lower ends thereof. Each of the front wheels 194 are preferably independently driven by a variable speed torque hub or hydraulic motor 196 connected thereto and the rear wheels 195 roll freely or may be described as idling wheels. The torque hubs 196 can be driven at different speeds or in opposite directions to steer the frame 185. It is also foreseen that the wheels 194 or 195 may be steerable. Upper and lower side beams 198 and 199 extend between the front and rear legs 191 and 192 proximate the upper and lower ends respectively.

The central support frame 187, supported between the left and right side frame assemblies 188 and 189, proximate upper ends thereof, includes left and right longitudinal beams 203 and 204 extending in parallel spaced apart relation with a pair of opposingly directed telescoping cross-beam assemblies mounted across both ends of the left and right longitudinal beams 203 and 204. First and second telescoping cross beam assemblies 207 and 208 extend across front ends of the left and right longitudinal beams 203 and 204 and third and fourth telescoping cross beam assemblies 209 and 210 extend across the rear ends of the left and right longitudinal beams 203 and 204.

Each telescoping cross-beam assembly 207-210 includes a tubular base or outer cylinder 213*a-d* with a piston or inner telescoping member 214*a-d* slidingly mounted therein. Hydraulic actuators 215*a-d* connected between each pair of outer cylinder 213*a-d* and inner telescoping member 214*a-d* respectively are operable to extend and retract the inner telescoping members 214*a-d* relative to the outer cylinders 213*a-d*. The outer cylinder 213*a* of the first telescoping cross beam assembly 207 is welded to the front ends of longitudinal beams 203 and 204 and the outer cylinder 213*b* of the second telescoping cross beam assembly 208 is welded across a front face of the outer cylinder 213*a*. The outer cylinder 213*c* of the third telescoping cross beam assembly 209 is welded to the rear ends of the longitudinal beams 203 and 204 and the outer cylinder 213*d* of the fourth telescoping beam cross beam assembly 210 is welded across a rear face of the outer cylinder 213*c*. Distal ends of inner telescoping members 214*a* and 214*c* are welded or otherwise connected to the upper side beam 198 of the right side frame assembly 189. Distal ends of inner telescoping members 214*b* and 214*d* are welded or otherwise connected to the upper side beam 198 of the left side frame assembly 188.

Figure 13:
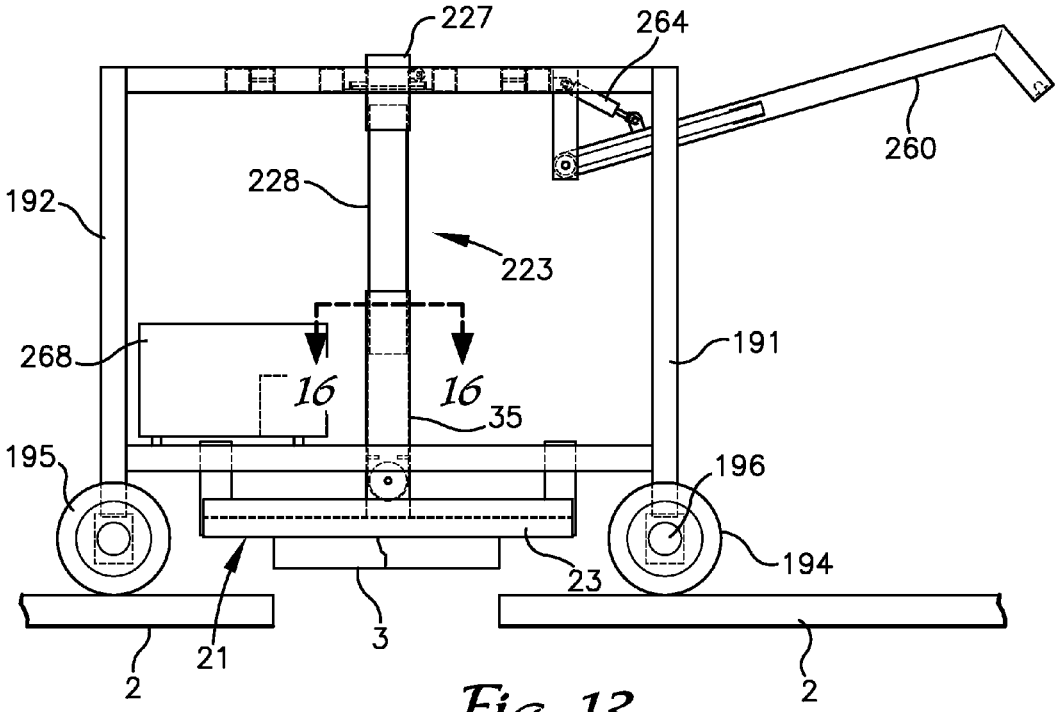
FIG. 13 is a side view of the mobile lifting frame with the slab jack connected thereto and an attached fragmented slab partially raised relative to the remaining section of the slab from which the fragmented slab was cut.
Figure 14:
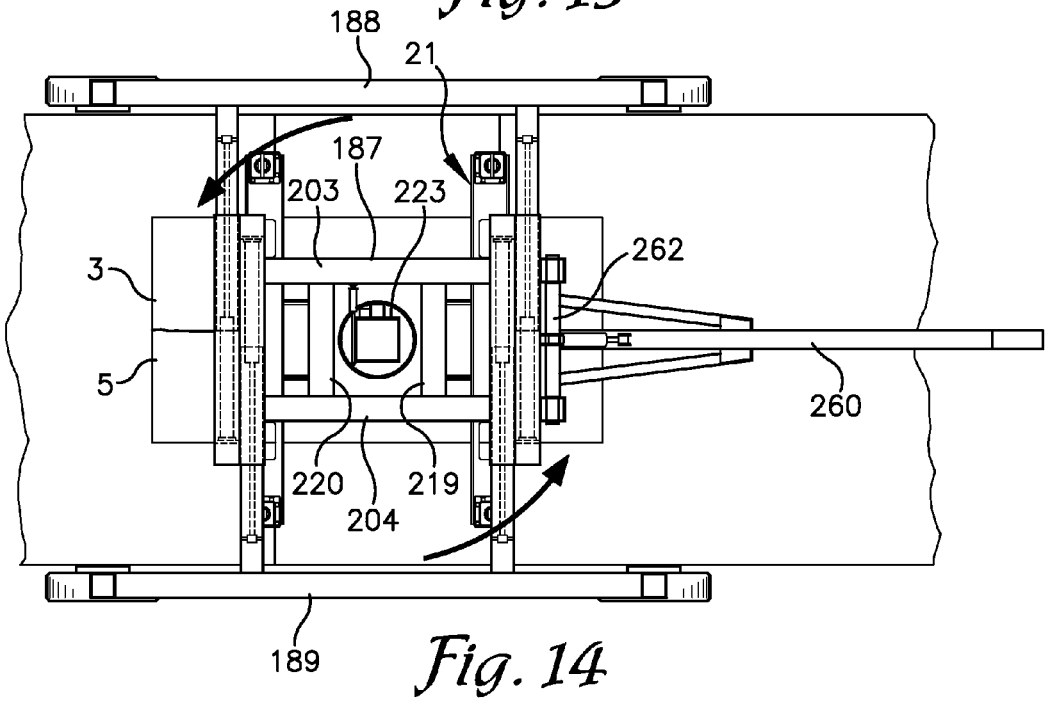
FIG. 14 is a top plan view of the mobile lifting frame in an extended configuration showing the slab jack and attached fragmented slab rotated ninety degrees relative to the original orientation of the fragmented slab.
Figure 15:
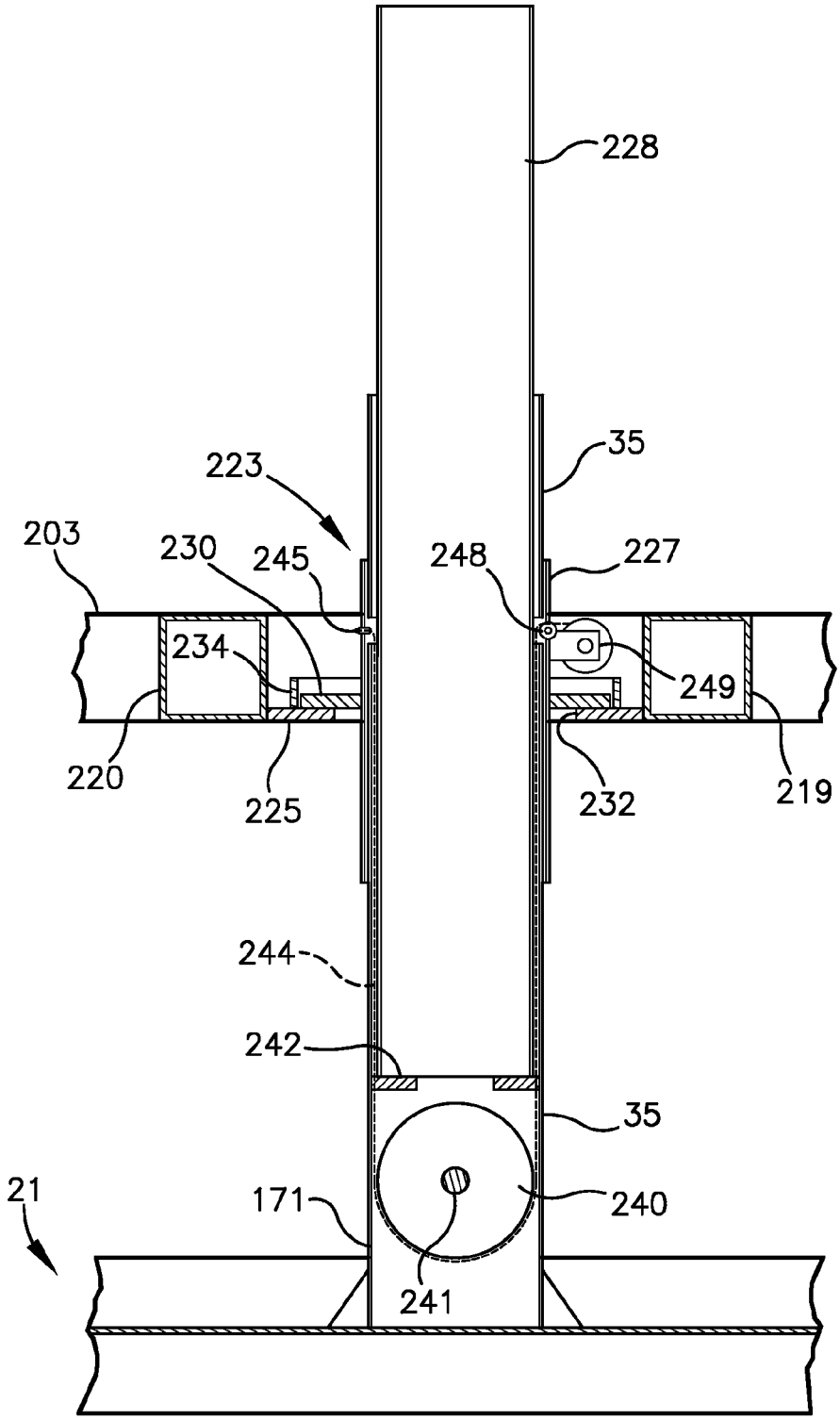
FIG. 15 is an enlarged and fragmentary cross-sectional view taken along line 15-15 of FIG. 12.
Figure 16:
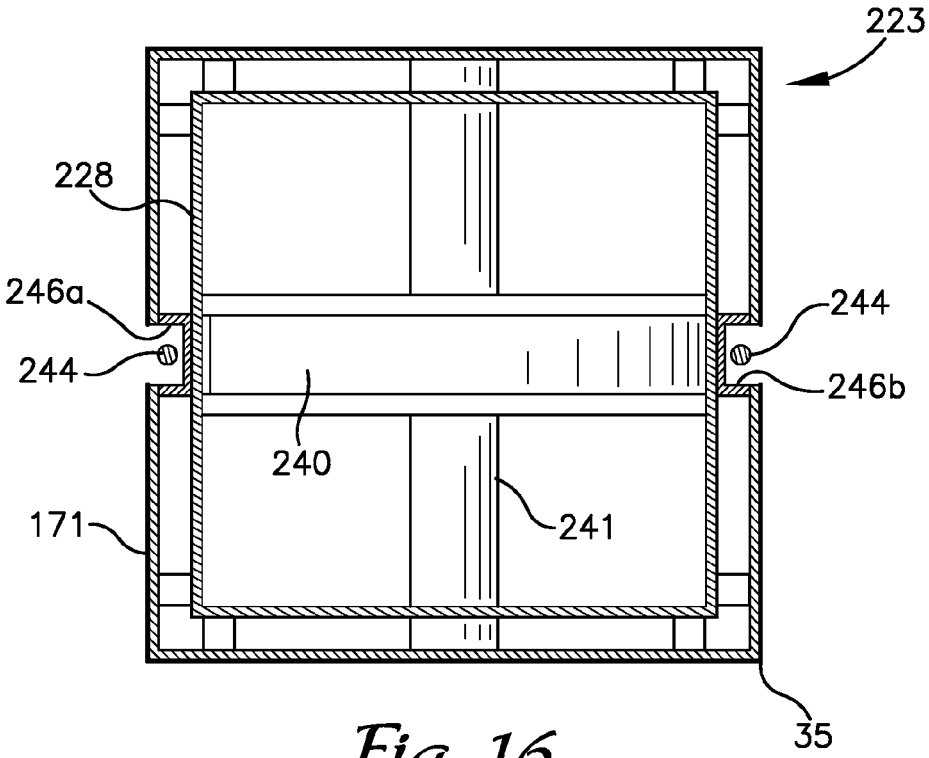
FIG. 16 is an enlarged and fragmentary view taken along line 16-16 of FIG. 15.
Figure 17:
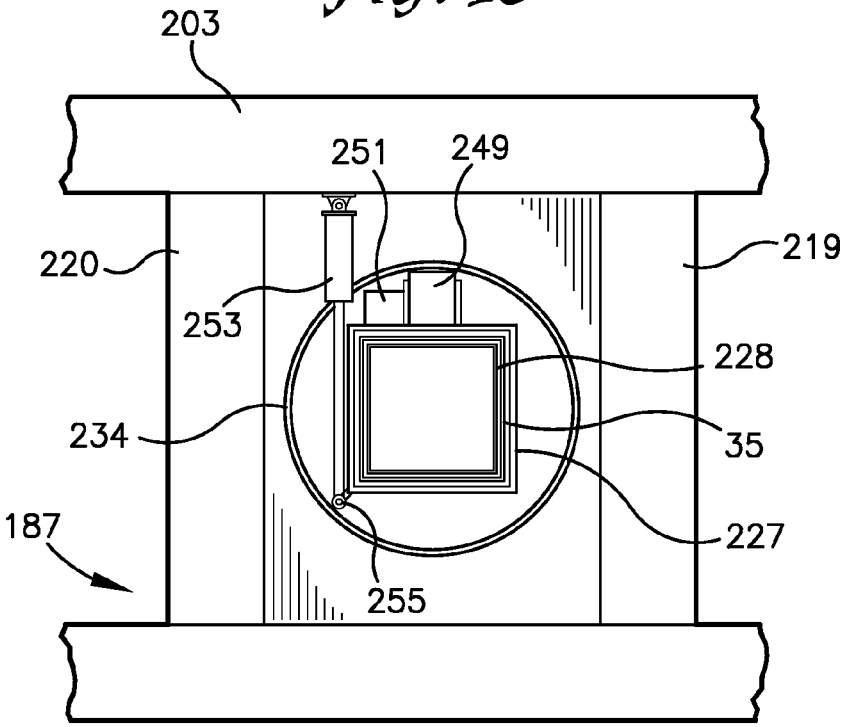
FIG. 17 is an enlarged and fragmentary, top plan view of the mobile lifting frame as in FIG. 14.

The central support frame 187 further includes front and rear lateral support beams 219 and 220 extending in parallel spaced relation between the left and right longitudinal beams 203 and 204. A telescoping lifting assembly 223, as best seen in FIGS. 13 and 15, is rotatably mounted on a support plate 225 welded to and extending between the front and rear lateral support beams 219 and 220 and the left and right longitudinal beams 203 and 204. The telescoping lift assembly 223 includes an outer sleeve 227 and inner sleeve 228 slidably mounted within the outer sleeve 227. The inner sleeve 228 is connected to the lift column 35 as discussed hereafter. In the embodiment shown, the outer and inner sleeves 227 and 228 are square in cross-section. The outer sleeve 227 includes a circular flange 230 welded to and projecting radially outward therefrom.

A circular opening 232 is formed through the support plate 225 for receiving the outer and inner sleeves 227 and 228 therethrough with the circular flange 230 projecting outward from the outer sleeve 227 and overlaying the support plate 225. A peripheral wall 234 projects upward from the support plate 225 coaxially with the opening 232 therethrough in spaced relation relative to an edge of the opening 232. The peripheral wall 234 is slightly wider in diameter than the circular flange 230 and functions to center the outer and inner sleeves 227 and 228 and the circular flange 230 relative to opening 232.

The lifting column 35 is modified for use with the telescoping lifting assembly 223 by first unbolting and removing the clevis 32 from the upper end of the square tube 171 forming lifting column 35. A pulley or sheave 240 is mounted on a horizontal shaft 241 within the square tube 171 forming the lifting column proximate a lower end thereof. The inner sleeve 228 of the telescoping lift assembly 223 fits within the square tube 238. One or more stops 242 formed on an inner surface of square tube 171 above the pulley shaft 241 prevents the distal end of the inner sleeve 228 from extending past the pulley shaft 241.

A lift cable 244 is fixedly connected at a first end 245 to the outer sleeve 227 or alternatively to the circular flange 230. The lift cable 244 is threaded downward between the outer and inner sleeves 227 and 228 along a first side thereof, and in a groove or channel 246*a* formed in an outer surface of the square tube 171 around the pulley 240 and back up the other side of the inner sleeve 228, in a corresponding groove 246*b* and inside of the outer sleeve 227. The grooves 246*a* and 246*b* may be formed by welding C-channels between two sections forming the square tube 171 and serve to hold the two sections together. The C-channels end above the pulley shaft 241 to allow the cable 244 to pass around the pulley 240. The cable passes over a second sheave 248 mounted on an upper end of the outer sleeve 227 and then to a winch 249 mounted on either the outer surface of the outer sleeve 227 or on an upper surface of the circular flange 230. The winch 249 may be driven by a hydraulic motor 251 to wrap the cable 244 there around pulling the lift column 35 upward relative to the inner and outer sleeves 228 and 227 until the stop 242 engages a distal end of the inner sleeve 228 at which point both the lift column 35 and the inner sleeve 228 are raised relative to and partially through the outer sleeve 227 thereby raising the patch puller 21 connected thereto along with the fragmented slab 3 connected to the patch puller 21. After the fragmented slab 3 is released, as discussed hereafter, unwinding of the winch 249 allows the patch puller 21 to lower with lift column 185 and inner sleeve 228 first telescoping relative to the outer sleeve 227 and then the lift column 35 telescoping relative to the inner sleeve 228 until the patch puller 21 is lowered onto the concrete slab 2 around another fragmented slab 3 cut therefrom. There may be some play between the inner sleeve 228 and outer sleeve 227 which permits some limited movement of the patch puller 21 connected thereto in any direction prior to setting it on the concrete slab 2 to permits some control on placement without having to move the entire lifting frame 185.

The telescoping lifting assembly 223 is rotatable relative to the lifting frame 185 using a hydraulic actuator 253 connected at one end to a portion of the central support frame 187, such as cross-beam 203, and at an opposite end to an arm or pivot arm 255 connected to the circular flange 230. The stroke of the actuator 253 is adapted to rotate the telescoping lifting assembly 223 at least ninety degrees and in one embodiment the actuator might rotate the telescoping lifting assembly approximately one hundred and eighty degrees or more to pivot the assembly from a first alignment and then ninety degrees in either direction.

A goose neck coupler 260 is pivotally connected to a coupler support frame 262 connected to the outer cylinder 213*b* of the front or second telescoping cross-beam assembly 208. A hydraulic actuator 264 connected between the gooseneck coupler 260 and the coupler support frame 262 is operable to raise and lower the gooseneck coupler 262 which extends forward of the front legs 191*a* distance sufficient to connect to a fifth wheel hitch 265 in a truck 266 used to tow the mobile lifting frame or crane 185 to a section of road from which fragmented slabs 3 are to be removed. When the goose neck coupler 260 is connected to the fifth wheel hitch 265 on a truck 266, the goose neck coupler 260 is adapted to raise the front wheels 194 off of the ground and pull the lifting frame 185 on the rear wheels 195 which roll freely.

A hydraulic power unit 268, including a hydraulic fluid reservoir, a pump and an engine for running the pump, shown schematically in the drawings, may be mounted on one of the lower side beams 199. Hydraulic power unit supplies pressurized hydraulic fluid to the hydraulic motors 196 connected to front wheels 194, hydraulic actuators 215*a-d* of the telescoping cross-beam assemblies 207-210, hydraulic motor 251 for winch 249, hydraulic actuator 253 for rotating the telescoping lifting assembly 223, and hydraulic actuator 264 for the gooseneck coupler 260. The hydraulic power unit 268 may supply hydraulic fluid under pressure to other hydraulic actuators, motors or the like used to operate the lifting frame 185.

Figure 11:
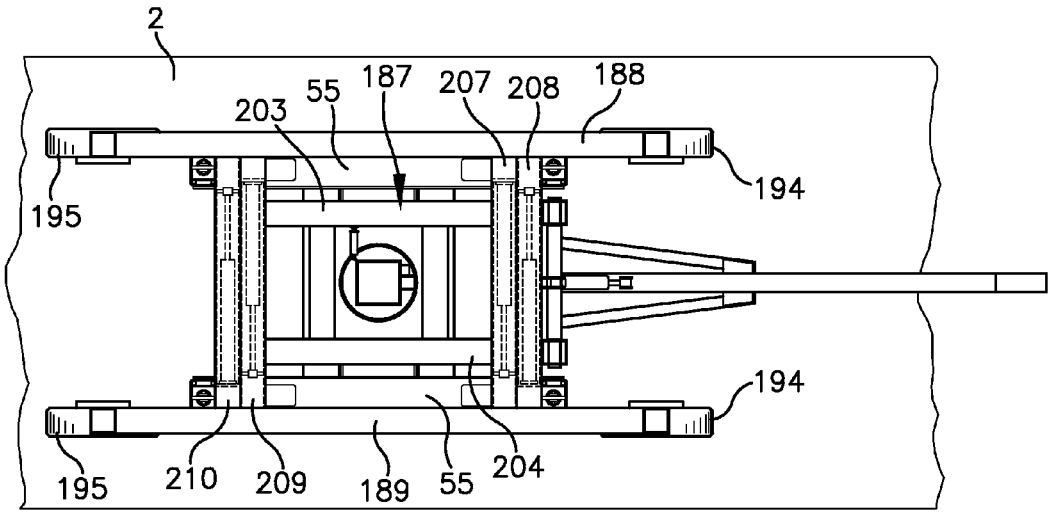
FIG. 11 is a top plan view of the mobile lifting frame shown in a retracted configuration for towing along a single lane of a road for transporting to a site at which fragmented slabs are to be removed from the slab forming the road.
Figure 12:
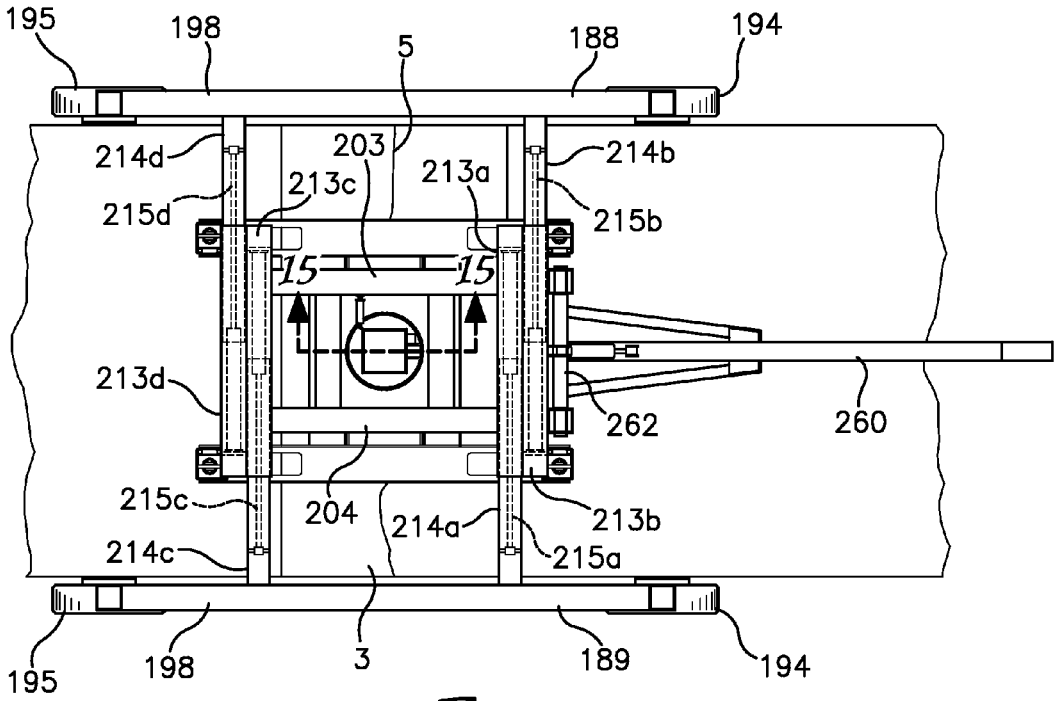
FIG. 12 is a top plan view of the mobile lifting frame shown in an extended configuration sized wider than a lane of the road and supporting the slab jack over a fragmented slab cut from the adjacent sections of the slab forming the lane of the road.

In use, the mobile lifting frame 185 is initially towed to a section of highway with fragmented slabs 3 to be removed by towing the frame 185 by truck 266 as discussed above. When towing the mobile lifting frame 185, the telescoping cross-beam assemblies 207-210 preferably have been drawn to a retracted position, as seen in FIG. 11, drawing the left and right frame assemblies 188 and 189 into a retracted configuration, approximately eight and one half feet wide, which is close to the maximum allowed width for a vehicle traveling on a highway in most jurisdictions. The patch puller 21 may be connected to the lifting frame 185 using the lifting column 35 connected to the telescoping lifting assembly 223 as discussed above. The patch puller 21 is connected to the lifting frame 185 such that the longitudinal legs 55 of the patch puller frame 23 extend parallel with the left and right frame assemblies 188 and 189.

After the mobile lifting frame 185, with the patch puller 21 secured thereto has been towed to the section of road on which the patch puller 21 is to be used, the front wheels 194 are lowered and the gooseneck coupler 260 is disconnected from the truck 266. The gooseneck coupler 260 is then raised by actuator 264 so the coupling end is pivoted upward. The hydraulic motors 196 driving front wheels 194 are then operated to drive the lifting frame 185 over a fragmented slab 3 to be removed. As the lifting frame 185 is moved into position, the actuators 215*a-d* are extended to expand the telescoping cross-beam assemblies 207-210 to expand the lifting frame 185 to a width that is slightly wider than a road lane so that the lifting frame 185 straddles the section of the roadway or concrete slab 2 containing the fragmented section 3 to be removed. The lifting frame 185 is typically expanded to a width that is a little wider than the width of the road lane or slab 2 so that the wheels 194 and 195 extend just outside the edges of the concrete slab 2 and are spaced laterally outward relative to the edges of the fragmented slab 3 to be removed which is typically the full width of the concrete slab 2. Because the wheels 194 and 195 extend just over or into adjacent lanes or shoulder formed by concrete slab 2, it typically does not require that lane to be closed down completely so that traffic can still pass by in the lane adjacent to the lane in which the fragmented section 3 is being removed.

Because the mobile lifting frame 185 is laterally expandable, the lifting frame 185 can travel directly or longitudinally down the roadway or slab 2, in a contracted configuration, between fragmented slab sections 3 and then upon approaching the next fragmented slab section 3 the frame 185 can be expanded laterally, outward so that the wheels can roll past the fragmented slab section 3 spaced outwardly therefrom and without encroaching on the adjacent lanes formed by concrete slabs 2 to a degree which would require the adjacent lane to be shut down. Once the lifting frame 185 is used to lift a fragmented slab section 3 out from the adjacent portions of slab 2, the lifting frame 185 can be rolled back away from overlapping relationship with the area in which the fragmented section 3 is removed and then once the last set of wheels 194 and 195 clears the area from which the fragmented section 3 is removed, the lifting frame 185 can be contracted if necessary to fit within a single lane of traffic.

Although all four sets of telescoping cross-beam assemblies 207-210 may be expanded simultaneously to expand the lifting frame 185 uniformly relative to the central support frame 187, it is foreseen that the expansion as to either side may be controlled so as not to be even with one of the left or right frame assemblies 188 or 189 expanding further from the central support frame 187 than the other.

Figure 18:
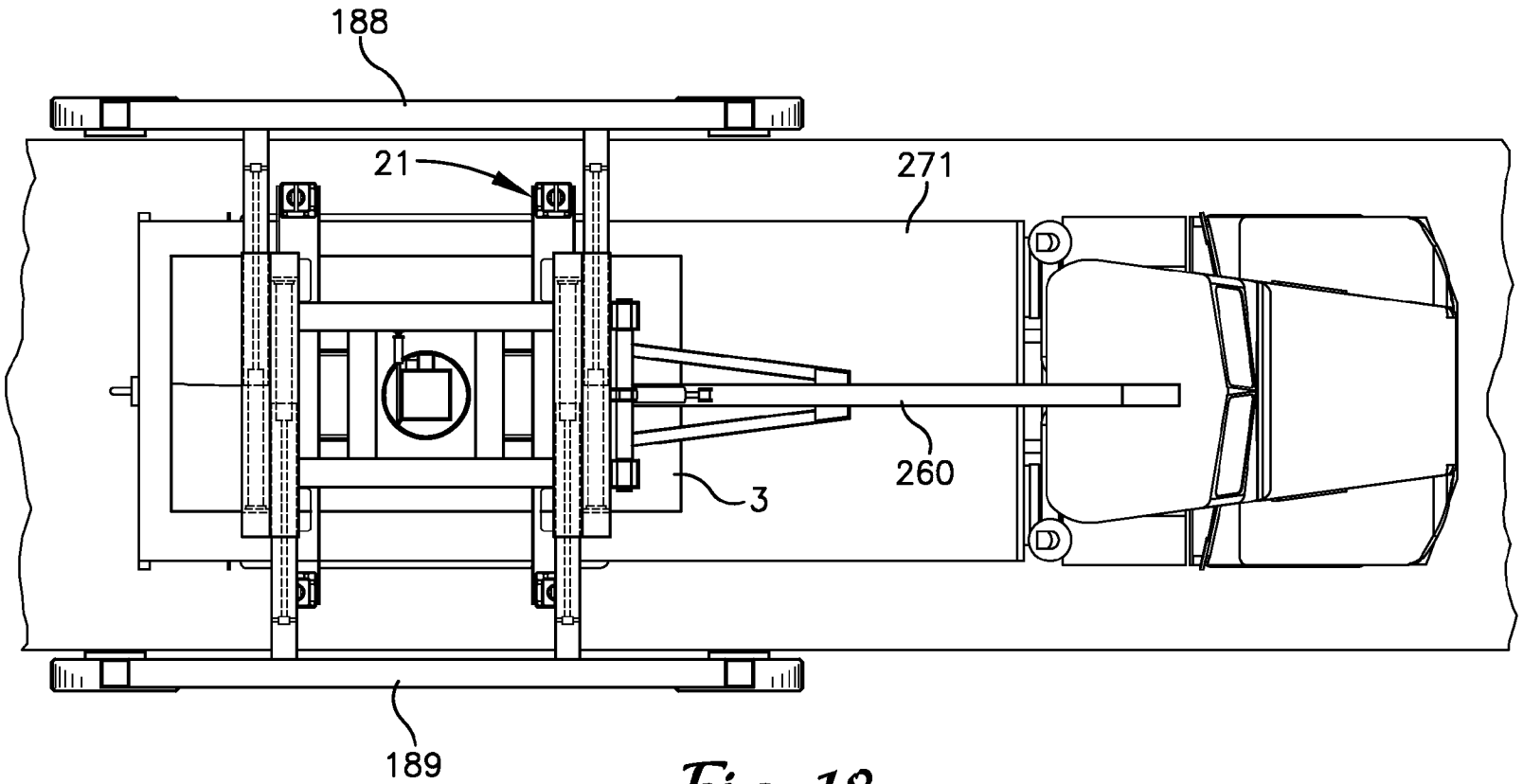
FIG. 18 is a top plan view of the mobile lifting frame as in FIG. 14 positioned over the bed of a truck with the slab jack and attached fragmented slab raised high enough to set the fragmented slab on the truck bed.

Once the mobile lifting frame 185 with the attached patch puller 21 has been rolled into position over a fragmented section 3 to be removed, if the longitudinal legs 55 of patch puller 21 still extend parallel to the left and right side frame assemblies 188 and 189, the patch puller 21 is rotated approximately ninety degrees so that the longitudinal legs 55 of the patch puller 21 extending across the width of the fragmented slab 3. The position of the mobile lifting frame 185 is fixed and the winch 249 is operated to lower the patch puller 21 into position for raising, or jacking up, the fragmented slab section 3 from the rest of the slab 2 as discussed in more detail previously. Once the fragmented slab 3 has been raised relative to the rest of the slab 2 using the jacks 29, the telescoping lifting assembly 223 is operated, using winch 249 to draw the lifting column 35 along with the patch puller 21 and attached fragmented slab 3 upwards relative to inner sleeve 228, until the inner sleeve 228 bottoms out relative to the lifting column 35 and then both the inner sleeve 228 and the lifting column 35 are drawn upward through the opening in the outer sleeve 227. The patch puller 21 and attached fragmented slab 3 are raised high enough so that the mobile lifting frame 185 with the patch puller 21 and fragmented slab 3 attached thereto may be rolled over a trailer or truck bed or other mobile support 271, as shown in FIG. 18, with the left and right frame assemblies 188 and 189 straddling or extending on either side of the truck bed 271. As the lifting frame 185 approaches a truck bed 271 onto which the attached fragmented slab 3 is to be placed, the lifting frame 185 can be expanded laterally to allow the lifting frame to straddle the truck bed 271 to facilitate unloading the attached fragmented slab 3 thereon.

Typically, prior to raising the patch puller 21 and attached fragmented slab 3 using the telescoping lifting assembly 223, the load may be balanced by sliding the lifting column 35 relative to the frame 23 of the patch puller 21 using actuator 181. For example, when a fragmented slab 3 is raised from between adjacent sections of the remaining slab 2, variations in the thickness of the slab, shifting of the slab fragments 9, or the uneven adhesion of additional road bed material to different sections of the fragmented slab 3 may move the center of gravity of the fragmented slab 3 to one side. By moving the frame 23 relative to the lift column 35 in a direction opposite the heavier side of the fragmented slab 3 the operator can produce a more balanced load.

Prior to driving the mobile lifting frame 185 over the truck bed 271, the patch puller 21 and attached fragmented slab 3 may be rotated ninety degrees so that the fragmented slab extends generally longitudinally relative to the mobile lifting frame 185 to facilitate transport. Rotating the patch puller 21 and attached fragmented slab 3 to a longitudinal alignment with the mobile lifting frame 185 facilitates reducing the width of the mobile lifting frame 185 as it moves between portions of the slab 2 from which a fragmented slab section 3 is to be removed and the truck bed 271 on which the fragmented slab 3 is to be deposited. If the patch puller 21 is not rotated into longitudinal alignment with the mobile lifting frame 185 prior to advancement of the mobile lifting frame 185 into straddling relationship with the truck bed 271, the patch puller is so rotated prior to release of the fragmented slab 3 onto the truck bed 271 so that the fragmented slabs 3 deposited thereon extend lengthwise relative to the truck bed 271. If the fragmented slabs 3 were laid transverse to the longitudinal axis of the truck bed 271, the truck would not be able to legally transport the fragmented slabs 3 on the road as the width of the fragmented slab sections 3 supported on the truck bed 271 would likely exceed the maximum allowable width. The patch puller 21 and attached fragmented slab 3 are rotated by rotating the telescoping lifting assembly 223 using hydraulic actuator 253 acting on the circular flange or turntable 230.

After the patch puller 21 has been positioned over the truck bed 271, the patch puller 21 is then lowered by unwinding the lift cable 244 from winch 249 to allow the telescoping lifting assembly 223 to extend until the fragmented slab 3 rests on the truck bed 271. The expansion pin assemblies 80 of the securement pins 27 are then retracted to release the fragmented slab 3 from the patch puller 21. The winch 249 is then run in the opposite direction to wind the lift cable 244 onto the winch 249, retracting the telescoping lifting assembly 223 and lifting the patch puller 21 above the fragmented slab 3.

The lifting frame 185 is then driven back away from the truck bed 271 and over the next fragmented slab 3 to be removed. The telescoping lifting assembly 223 and attached patch puller 21 may be rotated as necessary to facilitate transporting the patch puller 21 back over the next fragmented slab 3 to be removed and for positioning the patch puller 21 over the fragmented slab 3 with the jacks 29 supported on the adjacent slab 2. When use of the mobile lifting frame 185 to remove fragmented slabs 3 is complete, the telescoping cross-beam assemblies 207-210 may be retracted to reduce the width of the lifting frame 185 to approximately 8½ feet to fit within one lane and the gooseneck coupler 260 is lowered and connected to a fifth wheel hitch of a truck 266 for towing the lifting frame 185. It is also foreseen that the lifting frame 185 could be left connected to a truck for towing between fragmented sections 3 to be removed, for maneuvering the lifting frame 185 into place over the fragmented section and for maneuvering the lifting frame over a trailer 271 onto which the removed fragmented sections 3 are to be deposited.

Although not shown, it is foreseen that the telescoping lifting assembly 223 may also be mounted to the central support frame so that the position of the telescoping lifting assembly 223 is adjustable laterally or longitudinally or in both directions to facilitate proper centering of the patch puller 21 over the fragmented slab 3 to be removed or to facilitate loading the fragmented slab 3 onto a truck bed 271 or other support surface.

It is to be understood that while certain forms of the present invention have been illustrated and described herein, it is not to be limited to the specific forms or arrangement of parts described and shown. As used in the claims, identification of an element with an indefinite article "a" or "an" or the phrase "at least one" is intended to cover any device assembly including one or more of the elements at issue. Similarly, references to first and second elements is not intended to limit the claims to such assemblies including only two of the elements, but rather is intended to cover two or more of the elements at issue. Only where limiting language such as "a single" or "only one" with reference to an element, is the language intended to be limited to one of the elements specified, or any other similarly limited number of elements.

What is claimed and desired to be secured by Letters Patent is as follows:

1. A slab jack assembly for raising a fragmented slab upward and out from between sections of a concrete slab from which said fragmented slab is cut, the fragmented slab including a plurality of fragments; said slab jack comprising:

a) a planar support positionable on top of the fragmented slab;

b) first and second jacks connected to said planar support and positioned such that a base of each of said jacks engages an upper surface of the concrete slab; said first jack engaging the upper surface of the concrete slab outward from a first side of the fragmented slab and said second jack engaging the upper surface of the concrete slab outward from a second side of the fragmented slab;

c) a plurality of securement pins mounted on said planar support and insertable into holes bored in the plurality of fragments in the fragmented slab; said securement pins expandable within the holes bored in the plurality of fragments to secure said plurality of fragments to said planar support; and d) said first and second jacks operable to lift said planar support and said plurality of fragments secured thereto upward relative to said concrete slab; said slab jack assembly further comprising:

e) a lift connector connected to said planar support and removably connectable to a mobile carrier capable of lifting the lifting apparatus with or without a fragmented slab connected thereto relative to the concrete slab from which the fragmented slab is cut.

2. The slab jack assembly as in claim 1 wherein said first jack comprises a first pair of jacks and said second jack comprises a second pair of jacks, each of said jacks being independently operable.

3. The slab jack assembly as in claim 1 wherein said lift connector is mounted on a base which is laterally moveable relative to said planar support.

4. A slab jack assembly for raising a fragmented slab upward and out from between sections of a concrete slab from which said fragmented slab is cut, the fragmented slab including a plurality of fragments; said slab jack comprising:

a) a planar support positionable on top of the fragmented slab;

b) first and second jacks connected to said planar support and positioned such that a base of each of said jacks engages an upper surface of the concrete slab; said first jack engaging the upper surface of the concrete slab outward from a first side of the fragmented slab and said second jack engaging the upper surface of the concrete slab outward from a second side of the fragmented slab;

c) a plurality of wedge pins mounted on said planar support and insertable into holes bored in the plurality of fragments in the fragmented slab; said wedge pins expandable within the holes bored in the plurality of fragments upon drawing a portion of said wedge pin toward said planar support which simultaneously draws the fragments of the fragmented slab toward said planar support to secure said plurality of fragments to said planar support; and d) said first and second jacks operable to lift said planar support and said plurality of fragments secured thereto upward relative to said concrete slab.

5. A slab jack assembly for raising a fragmented slab upward and out from between sections of a concrete slab from which said fragmented slab is cut, the fragmented slab including a plurality of fragments; said slab jack comprising:

a) a planar support positionable on top of the fragmented slab;

b) first and second jacks connected to said planar support and positioned such that a base of each of said jacks engages an upper surface of the concrete slab; said first jack engaging the upper surface of the concrete slab outward from a first side of the fragmented slab and said second jack engaging the upper surface of the concrete slab outward from a second side of the fragmented slab;

c) a plurality of securement pins mounted on said planar support and insertable into holes bored in the plurality of fragments in the fragmented slab; said securement pins expandable within the holes bored in the plurality of fragments to secure said plurality of fragments to said planar support;

d) a load securement member moveably mounted relative to said support frame and extendable in parallel planar alignment below said support frame and into engagement with the fragmented slab secured to said planar support by said securement pins and e) said first and second jacks operable to lift said planar support and said plurality of fragments secured thereto upward relative to said concrete slab.

6. A slab jack assembly for raising a fragmented slab upward and out from between sections of a concrete slab from which said fragmented slab is cut, the fragmented slab including a plurality of fragments; said slab jack comprising:

a) a planar support positionable on top of the fragmented slab;

b) first and second jacks connected to said planar support and positioned such that a base of each of said jacks engages an upper surface of the concrete slab; said first jack engaging the upper surface of the concrete slab on a first side of the fragmented slab and said second jack engaging the upper surface of the concrete slab on a second side of the fragmented slab;

c) a plurality of securement pins mounted on said planar support and insertable into holes bored in the plurality of fragments in the fragmented slab; said securement pins expandable within the holes bored in the plurality of fragments to secure said plurality of fragments to said planar support; and d) said first and second jacks operable to lift said planar support and said plurality of fragments secured thereto upward relative to said concrete slab;

e) wherein said planar support comprises a support frame formed by a plurality of longitudinally extending beams and a plurality of cross-beams; each of said longitudinally extending beams and cross-beams having a pin opening formed therethrough through which an expansion pin of one of said plurality of securement pins extends, said expansion pin insertable into one of the holes bored in the plurality of fragments in the fragmented slab and expandable within the hole.

7. The slab jack assembly as in claim 6 wherein said openings in said longitudinally extending beams and said cross-beams extend longitudinally thereto and are at least three times as long as a width of said wedge pins; said lifting apparatus further including pin support plates slidably mounted on said longitudinally extending beams and said cross-beams over at least some of said pin openings, each of said pin support plates having a pin receiving slot formed therein extending transverse to said pin opening over which said pin support plate extends; said pin receiving slot being wider than a width of said wedge pins.

8. A slab jack assembly in combination with a mobile lifting frame for raising a fragmented slab upward and out from between sections of a concrete slab from which said fragmented slab is cut, the fragmented slab including a plurality of fragments; said slab jack assembly comprising: a planar support positionable on top of the fragmented slab; first and second jacks connected to said planar support and positioned such that a base of each of said jacks engages an upper surface of the concrete slab; said first jack engaging the upper surface of the concrete slab outward from a first side of the fragmented slab and said second jack engaging the upper surface of the concrete slab outward from a second side of the fragmented slab; a plurality of securement pins mounted on said planar support and insertable into holes bored in the plurality of fragments in the fragmented slab; said securement pins expandable within the holes bored in the plurality of fragments to secure said plurality of fragments to said planar support; said first and second jacks operable to lift said planar support and said plurality of fragments secured thereto upward relative to said concrete slab; said mobile lifting frame comprising lifting means connectable between said mobile lifting frame and said slab jack assembly for raising and lowering said slab jack assembly relative to said lifting frame; said lifting frame including rolling means mounted to allow rolling movement of said mobile lifting frame across the surface of the concrete slab.

9. The slab jack assembly in combination with said mobile carrier as in claim 8 wherein said lifting means comprises a telescoping lift assembly connectable between said mobile lifting frame and said slab jack assembly.

10. A slab jack assembly for raising a fragmented slab upward and out from between sections of a concrete slab from which said fragmented slab is cut, the fragmented slab including a plurality of fragments; said slab jack assembly comprising:

a) a support frame formed by first and second longitudinally extending beams extending in parallel spaced relation and connected together by a plurality of cross-beams;

b) first and second jacks connected to first ends of said first and second longitudinally extending beams and third and fourth jacks connected to second ends of said first and second longitudinally extending beams; a base of each of said jacks engages an upper surface of the concrete slab on opposite sides of said fragmented slab; said first and second jacks engaging the upper surface of the concrete slab on a first side of the fragmented slab and said third and fourth jacks engaging the upper surface of the concrete slab on a second side of the fragmented slab;

c) each of said first and second longitudinally extending beams and cross-beams having at least one pin receiving opening formed therethrough;

d) a plurality of securement pins each having an expandable pin assembly and mounted on said support frame with said expandable pin assembly extending through one of said pin receiving openings formed in said longitudinally extending beams and said cross-beams and insertable into a hole bored in one of the plurality of fragments in the fragmented slab; said expandable pin assembly expandable within the hole in which it is received to secure said fragment to said planar support;

e) said jacks operable to lift said support frame and said plurality of fragments secured thereto upward relative to said concrete slab.

11. The slab jack assembly as in claim 10 wherein said plurality of expansion pin assemblies comprise wedge pins expandable upon drawing a portion of said wedge pin toward said support frame to draw the fragments of the fragmented slab toward said support frame upon expansion of said wedge pins in the plurality of holes formed in the fragments.

12. The slab jack assembly as in claim 10 further comprising a first and second load securement member moveably mounted relative to said first and second longitudinally extending beams respectively, said first and second load securement members having a planar lower edge and extendable below said first and second load securement members and into engagement with the fragmented slab secured to said support frame by said securement pins.

13. The slab jack assembly as in claim 10 further comprising a lift connector connected to said planar support and removably connectable to a mobile carrier adapted to move the lifting apparatus with or without a fragmented slab connected thereto relative to the concrete slab from which the fragmented slab is cut.

14. The slab jack assembly as in claim 13 wherein said lift connector is mounted on a base which is laterally moveable relative to said planar support.

15. The slab jack assembly as in claim 10 in combination with a mobile lifting frame; said mobile lifting frame comprising a lifting means connectable between said mobile lifting frame and said slab jack assembly for raising and lowering said slab jack assembly relative to said lifting frame; said lifting frame including rolling means mounted to allow rolling movement of said mobile lifting frame across the surface of the concrete slab.

16. The slab jack assembly in combination with said mobile carrier as in claim 15 wherein said lifting means comprises a telescoping lift assembly connectable between said mobile lifting frame and said slab jack assembly.

17. A method for repairing a road formed from a slab having a crack, which may comprise a degraded joint, extending across the slab, the method comprising:

a) cutting through the slab on opposite sides of the crack to form a fragmented slab having at least one fragment on each side of the crack;

b) boring at least one hole through each fragment;

c) placing a slab securement frame having at least a first and second jack connected thereto over the fragmented slab such that the first jack is supported on the slab outward from a first side of the fragmented slab and the second jack is supported on the slab outward from a second side of the fragmented slab;

d) connecting each of the fragments to the slab securement frame by inserting an expandable pin connected to the slab securement frame into the bore in the fragment and expanding the pin;

e) actuating the first and second jacks to raise the fragmented slab relative to the slab; and f) after raising the fragmented slab relative to the slab by actuating the first and second jacks, lifting the slab securement frame including the first and second jacks and the fragmented slab connected to the slab securement frame upwards relative to the concrete slab, moving the slab securement frame and the fragmented slab connected thereto and then releasing the fragmented slab from the slab securement frame by contracting the expandable pins inserted in the bores in the fragments of the fragmented slab.

18. The method as in claim 17 further comprising the step of pressing a rigid load securement member having a planar lower edge and connected to said slab securement frame against an upper surface of the fragmented slab such that said load securement member extends across the degraded expansion joint and engages fragments on opposite sides of the degraded expansion joint.

19. A method for repairing a road formed from a slab forming a lane of traffic, said method comprising the steps of:

a) cutting from the slab a slab section to be removed having a width that is the same as or approximately the same as the width of the lane;

b) moving a mobile, expandable lifting apparatus longitudinally along the lane of traffic toward the slab section to be removed and expanding the mobile expandable lifting apparatus from a retracted condition to an expanded condition prior to advancement over the slab section to be removed; in the retracted condition, the mobile lifting frame being narrower than the width of the slab section to be removed and in the expanded condition wheels of the mobile, expandable lifting apparatus extending in spaced relation wider than the width of the slab section to be removed;

c) placing a slab securement frame having at least a first and second jack connected thereto over the slab section to be removed such that the first jack is supported on the slab outward from a first side of the slab section to be removed and the second jack is supported on the slab outward from a second side of the slab section to be removed;

d) securing the slab section to be removed to the slab securement frame;

e) actuating the first and second jacks to raise the slab section to be removed relative to the slab;

f) using a lifting mechanism on the mobile expandable lifting apparatus to lift the slab securement frame and the attached slab section to be removed to a height which is higher than a support surface of a mobile support platform;

g) moving the mobile, expandable lifting apparatus into straddling relationship with the mobile support platform and releasing the slab section to be removed from the slab securement frame and onto the mobile support platform.

20. The method as in claim 19 wherein during or after lifting the slab section to be removed using the lifting mechanism, the method further comprises rotating the slab section relative to the mobile, expandable lifting frame and about a vertical axis prior to releasing the slab section to be removed onto the mobile support platform.

21. The method as in claim 19 wherein said rotating step comprises rotating said slab section to be removed approximately ninety degrees relative to said mobile, expandable lifting frame.

22. The method as in claim 20 wherein the rotating step includes rotating about a vertical axis at least a portion of the lifting mechanism to which the slab section to be removed is attached to rotate the slab section to be removed.

23. A mobile slab lifting apparatus for moving a section of slab cut from a slab forming a lane of a road, the slab lifting apparatus comprising:

a) a framework including left and right side frame assemblies supported on wheels; the left and right side frame assemblies being laterally expandable relative to the direction of travel of the framework along the lane of the road between a retracted condition in which the width of the framework does not exceed the maximum width permitted for traveling along the lane of the road and an extended condition in which the wheels of the left and right side frame assemblies extend in outwardly spaced relation from outer edges of the lane of the road from which the section of slab is cut;

b) a planar support positionable on top of the section of slab to be moved;

c) means for securing said section of slab to be moved to said planar support;

d) first and second jacks connected to said planar support and positioned such that a base of each of said jacks engages an upper surface of the slab; said first jack engaging the upper surface of the slab outward from a first side of the section of slab to be moved and said second jack engaging the upper surface of the slab outward from a second side of the section of slab to be moved; said first and second jacks operable to lift said planar support and said section of slab secured thereto upward relative to said slab e) a lifting mechanism mounted between the left and right side frame assemblies and operable to lift the planar support and the section of slab secured thereto relative to the road.

24. The mobile slab lifting apparatus as in claim 23 wherein said lifting mechanism telescopes.

25. The mobile slab lifting apparatus as in claim 23 wherein said slab lifting mechanism is rotatable at least ninety degrees relative to the framework and about a vertical axis.

26. The mobile slab lifting apparatus as in claim 23 wherein the lifting mechanism is connected to a central support frame which is telescopically connected between and proximate upper ends of said left and right side frame assemblies.

* * * * *